US012503284B2

(12) United States Patent
Harlow

(10) Patent No.: US 12,503,284 B2
(45) Date of Patent: Dec. 23, 2025

(54) CONTAINER CLOSURE ASSEMBLY

(71) Applicant: ELDDIR LIMITED, Wales (GB)

(72) Inventor: Richard Harlow, Wales (GB)

(73) Assignee: ELDDIR LIMITED, Wales (GB)

( * ) Notice: Subject to any disclaimer, the term of this patent is extended or adjusted under 35 U.S.C. 154(b) by 0 days.

(21) Appl. No.: 18/283,646

(22) PCT Filed: Mar. 23, 2022

(86) PCT No.: PCT/GB2022/050729
§ 371 (c)(1),
(2) Date: Sep. 22, 2023

(87) PCT Pub. No.: WO2022/200788
PCT Pub. Date: Sep. 29, 2022

(65) Prior Publication Data

US 2024/0182214 A1 Jun. 6, 2024

(30) Foreign Application Priority Data

Mar. 24, 2021 (GB) ..... 2104165

(51) Int. Cl.
*B65D 50/06* (2006.01)
*B65D 51/24* (2006.01)

(52) U.S. Cl.
CPC ..... *B65D 50/061* (2013.01); *B65D 51/245* (2013.01)

(58) Field of Classification Search
CPC combination set(s) only.
See application file for complete search history.

(56) References Cited

U.S. PATENT DOCUMENTS 3,684,117 A * 8/1972 Leopoldi ..... B65D 55/145 215/206
3,843,007 A * 10/1974 Meyer ..... B65D 55/145 215/206

(Continued)

FOREIGN PATENT DOCUMENTS

EP 0043859 A1 1/1982

OTHER PUBLICATIONS

International Search Report from corresponding GB Application No. 2104165.2, mailed on Jan. 4, 2022, 3 pages.

(Continued)

*Primary Examiner* — Shawn M Braden
(74) *Attorney, Agent, or Firm* — Tucker Ellis LLP

(57) ABSTRACT

A container closure assembly comprising: a container neck (10); a cap (6) adapted to removably engage with the container neck (10), the cap (6) arranged to close an opening (12) of the container neck (10) when engaged therewith; one or more movable elements (14*a,* 14*b,* 14*c*), the movable elements arranged to provide a selective engagement between the container neck (10) and the cap (6). The one or more movable elements (14*a,* 14*b,* 14*c*) have one or more graphical indicia (16) thereon to form at least part of at least one decoy pattern. The one or more movable elements (Mas, 14*b,* 14*c*) have a locked configuration in which the cap (6) is engaged with the container neck (10) and the decoy pattern is complete. The one or more movable elements (14*sa,* 14*b,* 14*c*) have an unlocked configuration in which the cap (6) is disengaged from the container neck (10) and the decoy pattern is not complete. A container comprising the container closure assembly, a cap for a container, a container comprising the cap and a storage vessel are also disclosed.

20 Claims, 17 Drawing Sheets

(56) References Cited

U.S. PATENT DOCUMENTS

| | | | | |
|---|---|---|---|---|
| 8,517,193 | B1 * | 8/2013 | Small | E05B 37/025 215/208 |
| D747,606 | S * | 1/2016 | Serell | D3/274 |
| 2006/0180566 | A1 * | 8/2006 | Mataya | A61J 1/1425 215/230 |
| 2009/0249841 | A1 | 10/2009 | Holmes | |
| 2013/0062303 | A1 * | 3/2013 | Serell | E05B 37/02 215/206 |
| 2019/0100364 | A1 | 4/2019 | Bolen | |

OTHER PUBLICATIONS

International Search Report from corresponding International Application No. PCT/GB2022/050729, mailed on Jul. 6, 2022, 2 pages.

* cited by examiner

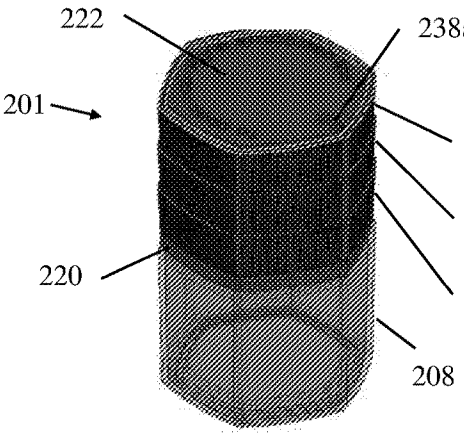
Figure 32
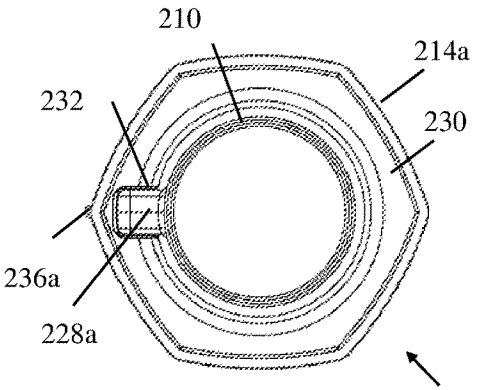
Figure 33
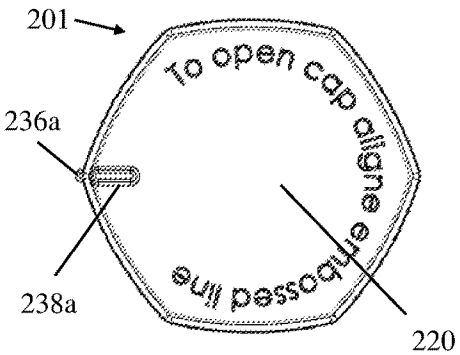
Figure 34
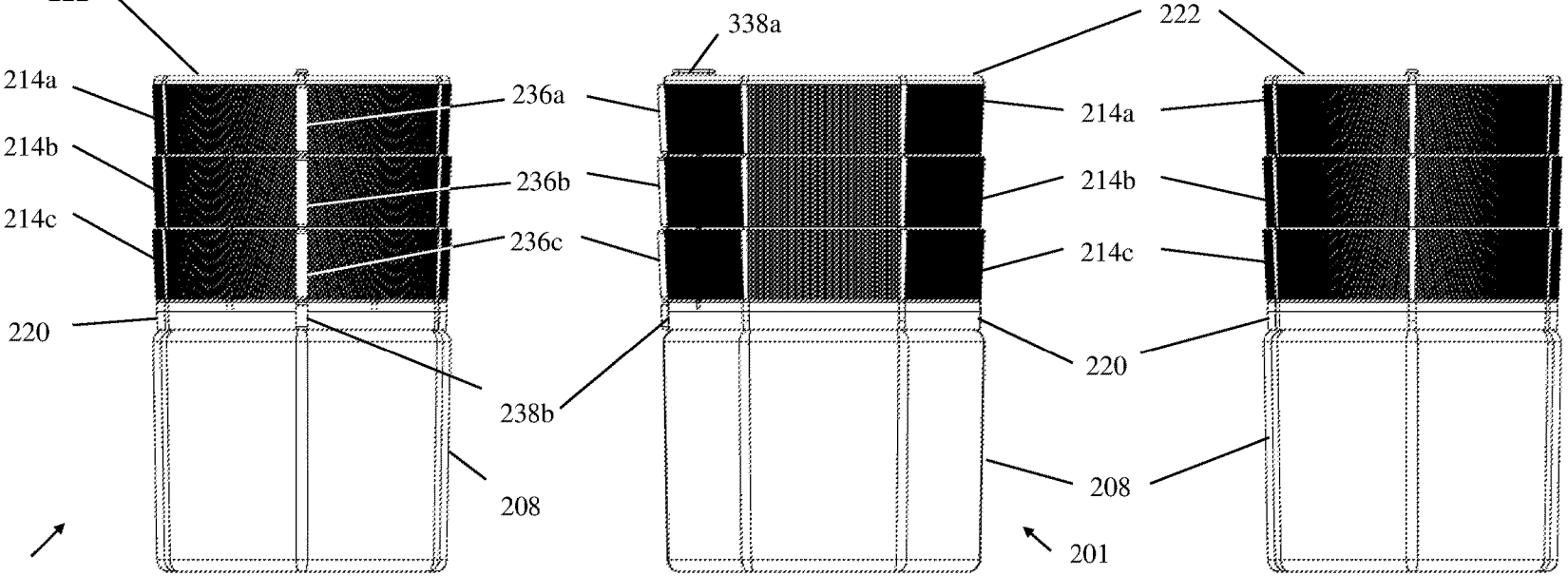
Figure 35
Figure 36
Figure 37

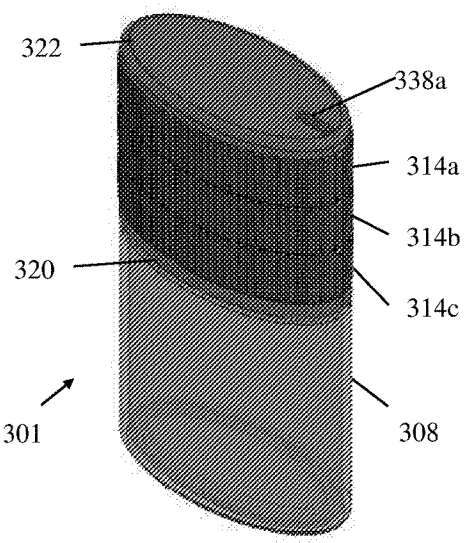
Figure 38
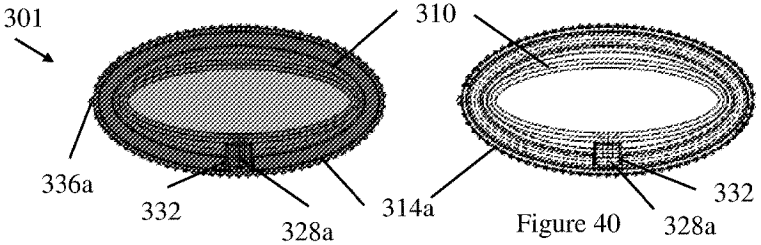
Figure 40
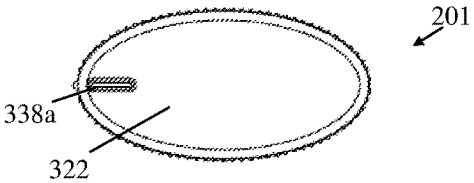
Figure 39
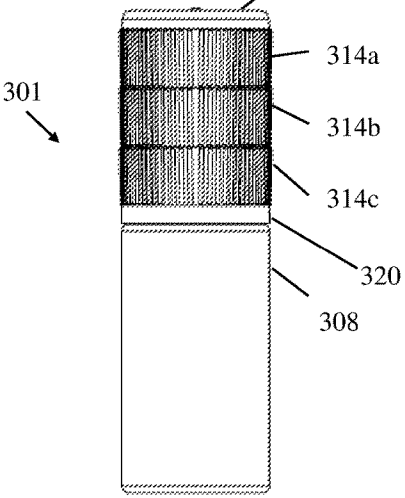
Figure 41
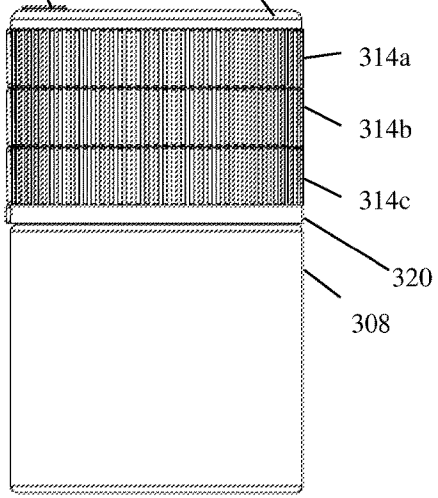
Figure 43
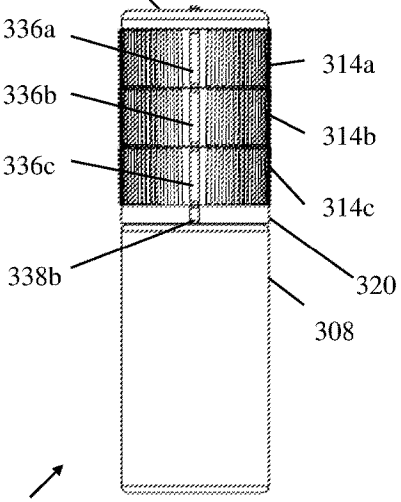
Figure 42
Figure 44

CONTAINER CLOSURE ASSEMBLY

RELATED APPLICATION DATA

This application is a national phase application of International Application No. PCT/GB2022/050729 filed Mar. 23, 2022, published in the English language, and which claims priority to application number GB 2104165.2 filed on Mar. 24, 2021. The entireties of the aforementioned applications are incorporated herein by reference.

TECHNICAL FIELD

The present disclosure relates to a container closure assembly, more particularly to a container closure assembly having a safety or child-resistant cap. The present disclosure also relates to a container comprising the container closure assembly, a cap for a container, and a storage vessel for a container.

BACKGROUND

It is known to fit a container with a child-resistant cap, in order to hinder or prevent a child from accessing the contents of the container. This may be important when the contents of the container are potentially harmful to a child, e.g. if ingested. Known child-resistant caps include those that are connected to a container by a screw thread, but which cannot be opened by turning alone. Such child-resistant caps have a safety mechanism that is released by the cap being squeezed or pushed as well as turned to allow it to be removed from the container.

One drawback of known child resistant caps is that they may also be too difficult for adults to open, especially for the elderly and those with disabilities e.g. sufferers of osteo or rheumatoid arthritis.

One known solution is to provide a locking cap that has a built in combination lock, an example of which is disclosed in U.S. Pat. No. 9,764,882B2. Such a cap can only be removed by inputting the correct combination code. While this may make the cap more secure against unwanted access, they are more complex to use as a unique code must be first programmed into the lock and remembered so that it can be opened. Many of the elderly individuals who struggle with existing child resistant caps may also suffer from age related memory loss, making remembering a combination code difficult. Known combination locks also require a lot of complex parts and are therefore more difficult to manufacture compared to conventional child-resistant caps.

SUMMARY

It is an object of the invention to address one or more of the above mentioned problems.

A first aspect provides a container closure assembly comprising:

- a container neck;
- a cap adapted to removably engage with the container neck, the cap arranged to close an opening of the container neck when engaged therewith;
- one or more movable elements, the movable elements arranged to provide a selective engagement between the container neck and the cap, wherein:
- the one or more movable elements have one or more graphical indicia thereon to form at least part of at least one decoy pattern,

- the one or more movable elements have a locked configuration in which the cap is engaged with the container neck and the decoy pattern is complete, and
- the one or more movable elements have an unlocked configuration in which the cap is disengaged from the container neck and the decoy pattern is not complete.

By providing a decoy pattern a child is drawn to the task of moving the one or more movable elements so that the pattern appears complete. In this configuration the cap cannot be removed from the container neck as the movable elements are in a locked configuration. In order to remove the cap, the movable elements are moved into a configuration in which the decoy pattern does not appear complete. The decoy pattern provides a false solution to the correct alignment of the one or more movable elements that acts as a distraction for any child attempting to gain access to the container. The closure assembly thus uses a partly cognitive barrier to a child opening the container, as opposed to only a physical barrier. This allows the closure assembly to be more easily opened by users with joint or muscle conditions that make operation of known child-resistant closures difficult. It also does not require the user to remember a key code as is the case for known combination lock closures.

The one or more movable elements may have further locked configurations in which the cap is engaged with the container neck and the decoy pattern is not complete.

The movable elements may be arranged to rotate about a longitudinal axis extending through the container neck.

Each of the movable elements may be movably mounted to one of the container neck or the cap, and the other of the container neck or the cap comprises one or more locking features. The one or more movable elements may be arranged to engage with the one or more locking features when in the locked configuration to resist removal of the cap from the container neck.

The movable elements may each comprise a turnable ring. The container neck and cap may have a circular cross section. The movable elements may have an inner surface that is circular in cross section (e.g. they have a circular aperture) arranged to fit around the container neck or cap. An outer surface of the movable elements may have a non-circular cross sectional profile.

The container neck and cap may have a non-circular cross sectional shape. Each of the movable elements may be formed from a flexible material, the movable elements being arranged to conform to the shape of the container neck and cap during rotation. This may allow the movable elements to rotate about a non-circular container neck by changing shape as they rotate.

The one or more movable elements or the one or more locking features may each comprise an engagement surface having a gap therein, and the other of the one or more movable elements and the one or more locking features may each comprise a corresponding locking protrusion. In the locked configuration the engagement surface or surfaces may be arranged to engage with a corresponding one of the locking protrusion or protrusions to resist removal of the cap. In the unlocked configuration the locking protrusion or protrusions may be arranged to pass through the gap or gaps to allow removal of the cap.

The engagement surface of each of the one or more movable elements may comprise a set of a plurality of gaps, each gap corresponding to one of a set of a plurality of locking protrusions. In the locked configuration the engagement surface or surfaces may each be arranged to engage with the locking protrusions of the corresponding set or sets of locking protrusions to resist removal of the cap. In the unlocked configuration the locking protrusions of the set or sets of locking protrusions may be arranged to pass through the gaps of the corresponding set or sets of gaps to allow removal of the cap.

The gaps within each set, and corresponding locking protrusions within each set, may be positioned such that only one orientation of each movable element relative to the container neck or the cap corresponds to the unlocked configuration.

The gaps within each set, and corresponding locking protrusions within each set, may have a different size and/or shape relative to the other gaps and protrusion in the same set whereby only one orientation of each movable element relative to the container neck or the cap corresponds to the unlocked configuration.

Any one or more of the locking protrusions may have a tapered profile at the point of engagement with a corresponding engagement surface. The tapered profile may form a camming surface arranged to urge the cap towards engagement with the container neck.

The engagement surface of each moveable element may be formed by the surface of a flange provided on each movable element. The gap or gaps in the engagement surface may each be formed by a notch in the flange.

The engagement surface of each movable element may be formed by a plurality of spaced apart radially extending ribs provided on each movable element. The gap or gaps in the engagement surface are each formed by a space between two adjacent ribs. This may be used in combination with a flexible material being used to form the movable elements. The use of radially extending ribs may allow the movable elements to more easily change shape as they rotate.

The one or more movable elements may comprise at least two movable elements having engagement surfaces each having at least one gap. In the unlocked configuration the gaps of the movable elements may form a continuous passageway or passageways through which the protrusions are free to pass to allow removable of the cap from the container.

The one or more protrusions may comprise at least two protrusions provided on the container neck, each corresponding to a corresponding one of the at least two movable elements.

The at least two protrusions may be spaced apart to allow passage of the engagement surface or surfaces between them.

The at least two protrusions may be arranged along an axis parallel to the longitudinal axis extending through the container neck.

The one or more movable elements may each have a marker feature thereon. The marker feature may be adapted to align with a corresponding marker feature on a relatively stationary part of the container closure assembly when the movable elements are in the unlocked configuration.

One or both of the marker features may be physical marker features.

The one or more movable elements may each further have a plurality of physical gripable features thereon. The grippable features may have a different size and/or shape compared to the marker feature of the respective movable element.

The physical marker features and/or the physical gripable features may be formed by surface indentations and/or protrusions.

The physical marker features and the physical gripable features may both be formed by indentations or both formed by protrusions.

The container closure assembly may comprise a plurality of movable elements arranged to rotate around an axis of rotation. At least one of the movable elements may comprise a first interlocking feature extending around the axis of rotation. The first interlocking feature may be arranged to inlock with a corresponding second interlocking feature of an adjacent one of the movable elements. This may help the movable elements to remain concentrically aligned during rotation.

The first interlocking feature may comprise a base portion of the respective movable element having a circumferentially extending interlocking surface that is sized to fit within a corresponding interior surface of the adjacent moveable element. This may allow the movable elements to interlock to maintain their relative alignment.

A second aspect provides a container comprising the container closure assembly of the first aspect. The container may comprise a storage vessel. The storage vessel may comprise a storage chamber and the container neck. The container neck may be formed integrally with the storage vessel or fixedly attached thereto.

A third aspect provides a cap for a container, the cap being adapted to removably engage with a container neck of the container to close an opening of the container neck when engaged therewith, wherein the cap comprises one or more movable elements, the movable elements arranged to provide a selective engagement between the container neck and the cap, and wherein:

the movable elements have one or more graphical indicium thereon to form at least one decoy pattern, the movable elements have a locked configuration in which the decoy pattern is complete and the cap is arranged to engaged with the container neck, and the movable elements have an unlocked configuration in which the decoy pattern is not complete and the cap is arranged to be disengageable from the container neck.

A fourth aspect provides a container comprising the cap of the third aspect. The container may comprise a storage vessel. The storage vessel may comprise a storage chamber and the container neck. The container neck may be formed integrally with the storage vessel or fixedly attached thereto. The container neck may have a locking feature or features adapted to engage with the movable elements in the locked configuration.

A fourth aspect provides a storage vessel comprising a storage chamber and a container neck formed integrally with the storage chamber or fixedly attached thereto, the container neck adapted to removably engage with a cap to close an opening of the container neck when engaged therewith, wherein the container neck comprises one or more movable elements, the movable elements arranged to provide a selective engagement between the container neck and the cap, and wherein:

the movable elements have one or more graphical indicium thereon to form at least one decoy pattern, the movable elements have a locked configuration in which the decoy pattern is complete and the cap is arranged to engaged with the container neck and, and the movable elements have an unlocked configuration in which the decoy pattern is not complete and the cap is arranged to be disengeable from the container neck.

A fifth aspect provides a container comprising the storage vessel of the fourth aspect, wherein the container comprises a cap having a locking feature or features adapted to engage with the movable elements in the locked configuration.

The storage vessel of any of the above aspects may comprise a first section comprising a first storage section and a first container neck portion, and a second section comprising a second storage section and second container neck portion. This may provide separate storage compartments within the storage vessel.

The first and second storage sections of the storage vessel may be coupled together by a coupling. The coupling may be arranged to prevent the section of the storage vessel that does not engage with the closure assembly from sliding free from the cap. The coupling may be a detachable coupling. The first and second sections of the storage vessel may be coupled via the coupling when the cap is on the container. The first and second sections of the storage vessel may be detached from one another when the cap is removed.

The person skilled in the art will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Example embodiments will now be described with reference to the accompanying drawings, in which:

FIGS. 32, 33, 34, 35, 36, and 37 show perspective, top sectional, top, front elevation, side elevation and rear elevation views respectively of an example embodiment of a container having movable elements with a hexagonal outer surface;

FIGS. 38, 39, 40, 41, 42, 43 and 44 show perspective, first top sectional, second top sectional, top, first side elevation, front elevation and second side elevation views respectively of an example embodiment of a container having a container neck with an elliptical cross sectional shape and flexible movable elements;

DETAILED DESCRIPTION

Figure 1:
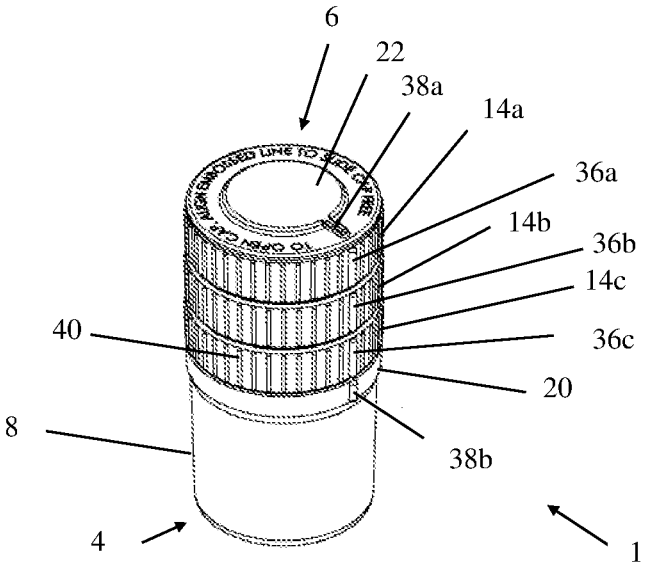
FIG. 1 shows an example embodiment of a container comprising a storage vessel with a cap fitted thereto.
Figure 2:
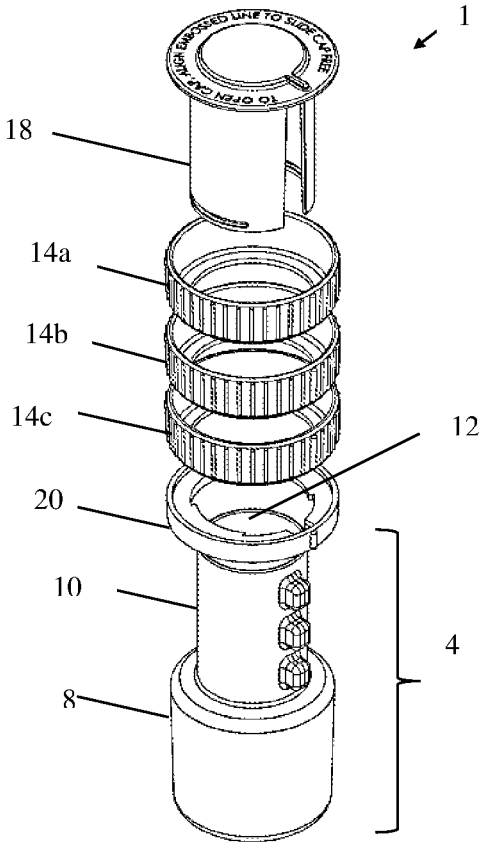
FIG. 2 is an exploded view of the container of FIG. 1.

FIGS. 1 and 2 show an example embodiment of a container 1 having a closure assembly in an assembled and an exploded view. The container 1 generally comprises a storage vessel 4 and a cap 6. The storage vessel 4 comprises a storage chamber 8 in which the contents of the container is held. The storage vessel 4 further comprises a container neck 10 extending from the storage chamber 8 and in communication thereto. The container neck 10 is hollow and forms the mouth of the storage vessel 4 having an opening 12 through which the storage chamber 8 is accessed. The container neck 10 may be formed integrally with the storage chamber 8 when the storage vessel 4 is formed, or may be otherwise formed separately and attached thereto at a later time. The container neck may alternatively be referred to as a mouth portion of the container. The container neck 10 and the cap 6 are arranged to operatively engage to form the closure assembly.

In the described embodiment, the container 1 is a medicine bottle for storage of tablets, liquid medicine or the like. In other embodiments, the container 1 may be used for other applications where a child-resistant closure is needed, for example storing house hold cleaning products, chemicals, etc (an example of which is described later). The size and shape of the container 1 shown in the Figures is therefore to be understood as exemplary only.

Figure 14:
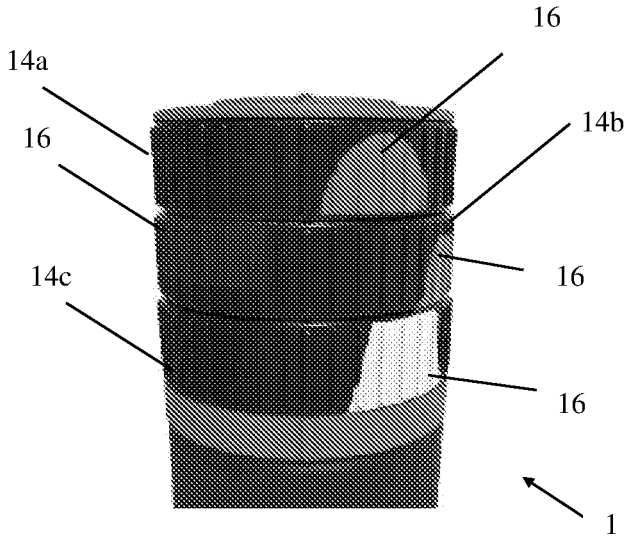
FIG. 14 shows a close-up view of a cap with a decoy pattern in an incomplete configuration and movable elements in an unlocked configuration in which the container can be opened.

The cap 6 is adapted to removably engage with the container neck 10 so as to close the opening 12 and seal the storage vessel 4. The closure assembly further comprises three movable elements 14*a*, 14*b*, 14*c*. Referring to FIG. 14, the movable elements 14*a*, 14*b*, 14*c* have graphical indicia 16 thereon to form a decoy pattern. The graphical indicia 16 are provided on the movable elements 14*a*, 14*b*, 14*c* e.g. on an outer surface of those elements that is visible in use. While the figures show an embodiment having three movable elements this may not be the case as described later. The closure assembly more generally comprises one or more movable elements.

The indicia are shapes, images or symbols or the like that together can be arranged into a logical decoy pattern by movement of the movable elements. The indicia act as a diversionary puzzle that a child will be drawn to and attempt to complete by moving the movable elements 14*a*, 14*b*, 14*c* to arrange the indicia into a completed pattern.

The movable elements 14*a*, 14*b*, 14*c* have a locked configuration in which the cap 6 is engaged with the container neck 10 and cannot be removed to open the container. In the locked configuration the movable elements 14*a*, 14*b*, 14*c* are positioned such that the decoy pattern is complete. The movable elements 14*a*, 14*b*, 14*c* further have an unlocked configuration in which the cap 6 is disengaged from the container neck 10 and so can be removed to open the container 1. In the unlocked configuration, the decoy pattern is not complete, as is illustrated in FIG. 14. The movable elements may have further locked positions in which the cap is engaged with the container neck but the decoy pattern is not complete.

By providing a decoy pattern on the movable elements 14*a*, 14*b*, 14*c* a child attempting to open the container will be drawn to the task of arranging the indicia forming the pattern so that it appears complete. When the moveable elements are moved to complete the pattern in this way they remain in a locked configuration and the cap cannot be removed from the container neck. An adult who wishes to open the container may move the movable elements 14*a*, 14*b*, 14*c* so that they are in the unlocked configuration. By using a decoy alignment in this way the child-resistant closure does not rely on a physical barrier to opening the container that some adults may otherwise find difficult to operate.

Figure 15:
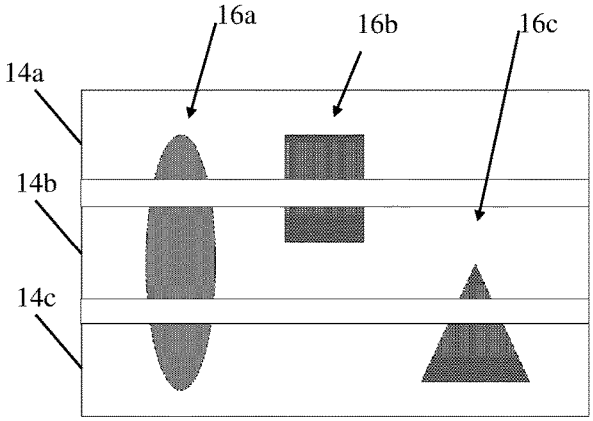
FIG. 15 illustrates turnable rings configured such that a decoy pattern is complete.
Figure 16:
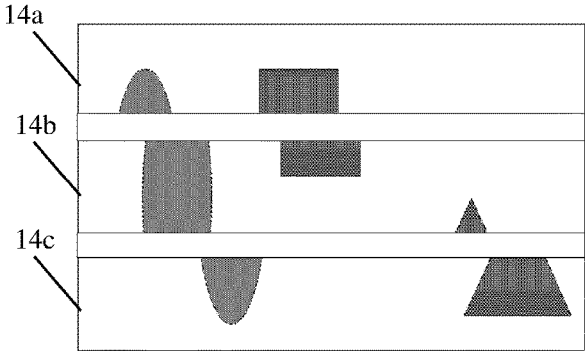
FIG. 16 illustrates the turnable rings of FIG. 15 in a configuration in which the decoy is incomplete.

FIGS. 15 and 16 illustrates an example of indicia 16*a*, 16*b*, 16*c* that form a decoy pattern. The pattern is complete in FIG. 15, and incomplete in FIG. 16. In this example, the decoy pattern has a completed configuration in which separate parts of the indicium or indicia from which it is formed are aligned. The decoy pattern has an uncompleted configuration in which separate parts of the indicium or indicia are misaligned with respect to one another. In the present example, the indicia are formed by shapes (which may be of differing colours, sizes and shape). Each shape is arranged so that it extends over at least two adjacent movable elements. By rotating the movable elements the separate parts of the shape may be aligned. In other embodiments, the indicium or indicia may each comprise a single image, shape, symbol or pattern, or multiple images, shapes. For example, a single image or geometric pattern may extend over all of the movable elements so that the separate parts of the pattern may be aligned such that it appears completed.

The skilled person will understand that a number of different types of decoy pattern can be used so long as they have suitable complete and incomplete configurations. In the present embodiment, block colour shapes are used to form the decoy pattern. These may be advantageous as they are efficient to print on the surface of the movable elements. More complex prints and images may however be used, including various graphics and forms. The decoy patterns can be multiple colours, all in the same colour, and/or use various shapes and patterns in other embodiments.

The decoy pattern may be provided by creating indicia on the movable elements (or other part of the closure mechanism) using a number of different methods. In the present embodiment, the indicia forming the decoy pattern are printed onto a surface of the movable elements. In other embodiments, the indicia may be molded (e.g. molded shapes in the body of the movable elements), cut or dual shot molded. Any suitable technique may be used such that a visible decoy pattern is formed.

In the present embodiment, the indicia provided on the movable elements form a single decoy pattern. In other embodiments, more than one decoy pattern may be provided. In such embodiments, the decoy patterns each have a corresponding completed configuration which corresponds to a locked configuration of the movable elements (therefore in which the container cannot be opened).

Although in the presently described embodiment the decoy pattern is formed on the movable elements it may further be provided at least partly on another adjacent part of the storage vessel or cap. In such an embodiment, only one movable element may be required, the decoy pattern being in two parts—one on the single movable element, the other on an adjacent relatively stationary part of the cap or container (e.g. the locking member described later).

While in the presently described embodiment three movable elements are provided there may in other embodiments be one, two or any number greater than four. Where there are two or more movable elements the decoy pattern may extend over the movable elements and an adjacent stationary part or parts of the container, or may be only on the movable elements as shown in the Figures.

Figure 3:
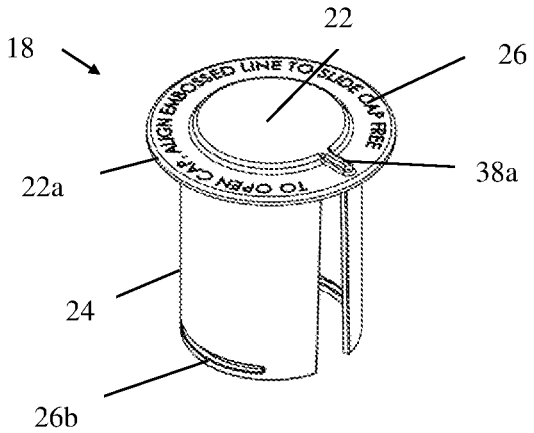
FIG. 3 is a perspective view of a closure member of the cap of FIG. 1.
Figure 4:
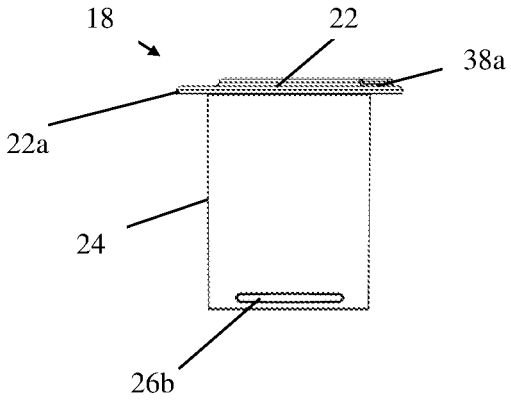
FIG. 4 is a side elevation view of the closure member shown in FIG. 3.

Referring to FIG. 2, the cap 6 generally comprises a centre or closure member 18 and a retaining member 20. Further details of each of these components are illustrated in FIGS. 3 to 10 which show them separately. Referring initially to FIG. 3, the closure member 18 is adapted to fit over the container neck 10 so as to close the opening 12. The closure member 18 comprises a lid portion 22 and a tubular portion 24 extending therefrom. The retaining member 20 of the cap 6 is adapted to fixedly couple to a distal end of the closure member 18 opposite to the lid portion 22.

Figure 11:
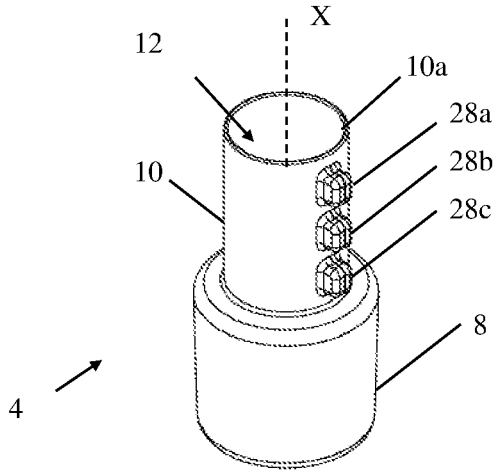
FIG. 11 is a perspective view of a storage vessel of the container of FIG. 1.
Figure 12:
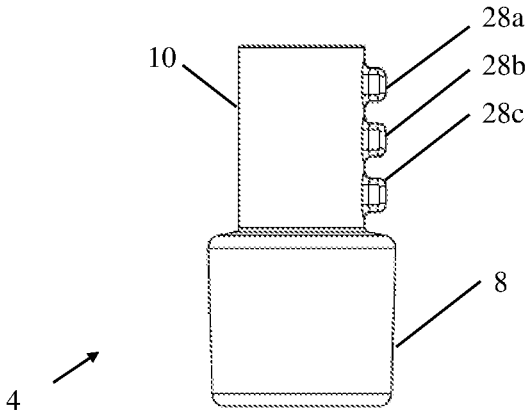
FIG. 12 is a side elevation view of the storage vessel of FIG. 11.

The lid portion 22 is arranged to fit over the opening 12 of the container neck 10 in use, such that the container neck 10 engages with (i.e. is received within) the tubular portion 24. The tubular member therefore forms a hollow component which can slide over the container neck 10. A close fit may be provided between an inner surface of the tubular portion 24 and the outer surface of the container neck 10 to help retain the cap 6 onto the container neck 10. In some embodiments, the closure member 18 may comprise a sealing element such as an O-ring seal (not shown in the Figures) adapted to engage with a sealing surface on the container neck 10 (e.g. the rim 10*a* of the container neck around the opening 12 as can be seen in FIG. 11). This may provide a liquid or air tight seal between the cap 6 and the container neck 10. A slot may be provided in the container neck 10 arranged to act as a spout. A label 26 or wording printed on the lid portion 22 is provided to explain how the user may operate the closure assembly. In other embodiments, the label 26 is cut or moulded into the lid portion rather than being printed.

As can be seen in FIG. 2, the movable elements 14*a*, 14*b*, 14*c* are mounted to the cap 6 so that they can move relative thereto. Each of the movable elements 14*a*, 14*b*, 14*c* comprises a turnable ring that extends around the closure member 18 of the cap 6, and are movable about the longitudinal axis extending through the container neck 10 (i.e. when the cap is engaged with it). The movable elements 14*a*, 14*b*, 14*c* are stacked axially along a longitudinal axis of the cap 6 and are retained in the axial space between an overhang rim 22*a* of the lid portion 22 and the retaining member 20.

Figure 5:
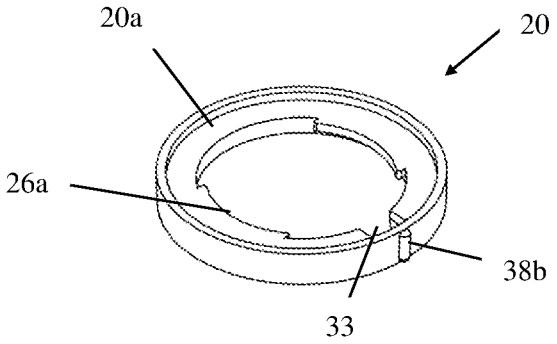
FIG. 5 is a perspective view of a retaining member of the cap of FIG. 1.
Figure 6:
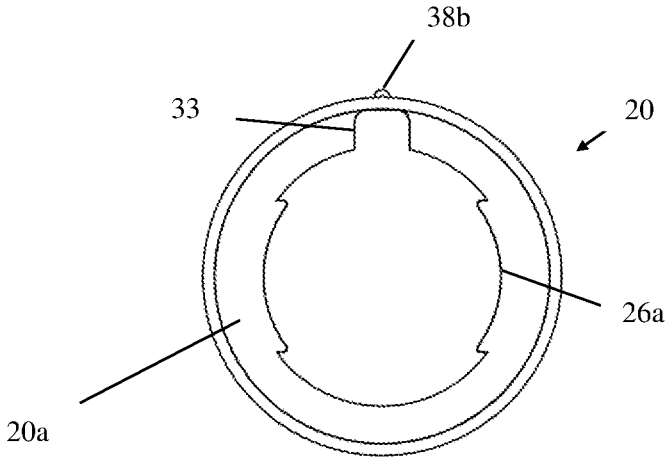
FIG. 6 is a top view of the retaining member of FIG. 5.
Figure 7:
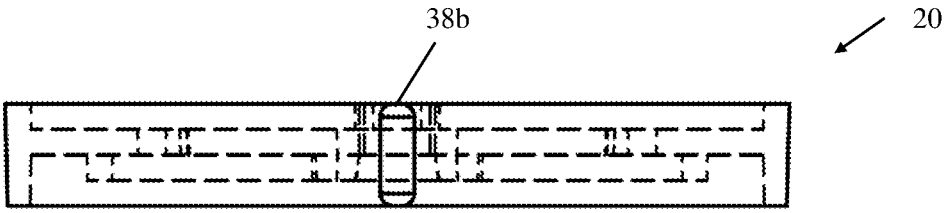
FIG. 7 is a side elevation view of the retaining member of FIG. 5.
Figure 8:
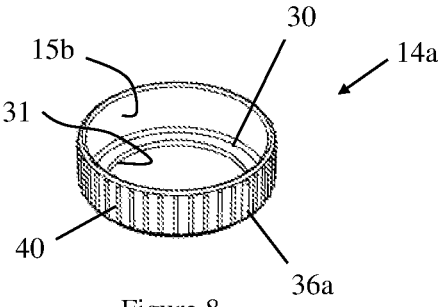
FIG. 8 is a perspective view of a turnable ring of the cap of FIG. 1.

The retaining member 20 is shown separately in FIGS. 5, 6 and 7. The retaining member 20 is formed by a locking ring arranged to extend around the tubular portion 24 of the cap 6 in a similar manner to the movable elements 14*a*, 14*b*, 14*c*. The retaining member 20 comprises a locking feature 26*a* that is arranged to engage with a corresponding locking feature 26*b* provided on the tubular portion 24 of the cap 6 to secure them together. The locking feature 26*a* on the retaining member 20 is formed by a pair of recesses in an inner radial surface 20*a* of the locking ring that are arranged to cooperate with a pair of ridges on the tubular member 24. The locking features are arranged to provide a snap-fit connection between the retaining member 20 and the cap. For example, the retaining member 20 can be snapped into place by squeezing the tubular portion 24 of the cap and allowing it to expand or snap onto the locking feature of the retaining member. Other methods of fixing the retaining member to the closure member may be used. For example, snap-fit or hooked connectors may be moulded into the retaining member and tubular portion of the cap (as will be described in more detail later), or the retaining member 20 may be held in place by an adhesive or the like.

The movable elements 14*a*, 14*b*, 14*c* are arranged to provide a selective engagement between the cap 6 and the container neck 10. In the presently described embodiment, the movable elements 14*a*, 14*b*, 14*c* are each arranged to engage with a corresponding locking protrusion 28*a*, 28*b*, 28*c* provided on the container neck 10. In the present embodiment, a separate protrusion is provided to engage with each of the movable elements. As can be seen in FIG. 3, the closure member 18 of the cap comprises a slot 19 through which the protrusions 28*a*, 28*b*, 28*c* extend when the closure member is fit over the container neck 10. The slot 19 is a longitudinal slot extending axially along the length of the tubular member 24 from the lid portion 22. The protrusions 28*a*, 28*b*, 28*c* have a corresponding axial arrangement along the outer surface of the container neck 10 as can be seen in FIG. 2 so that they may extend through the slot 19 and the closure member 22 may slide over the container neck 10 to close the opening 12 of the storage vessel.

Figure 9:
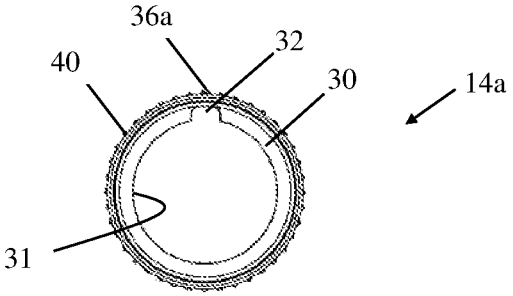
FIG. 9 is a top view of the turnable ring of FIG. 8.

Referring to FIG. 9, each of the turnable rings forming the movable elements 14*a*, 14*b*, 14*c* comprise a portion defining an engagement surface 30 adapted to engage with a corresponding one of the locking protrusions 28*a*, 28*b*, 28*c* on the container neck 10 when in the locked configuration. Each of the engagement surfaces has a notch 32 that forms a gap or space in the engagement surface through which the protrusions may pass. The notch extends through the thickness of the portion of the turnable rings forming the engagement surface. In the locked configuration, the engagement surface 30 is arranged to abut or contact the corresponding protrusion 28*a*, 28*b*, 28*c* so as to resist removal of the cap 6 from the container neck 10. The notch 32 is arranged to align with the corresponding locking protrusion by rotation of the respective movable element 14*a*, 14*b*, 14*c* into the unlocked configuration. The notches 32 are sized so as to allow the protrusions to pass through the engagement surface 30, thereby allowing removal of the cap 6 from the container neck 10. The engagement surfaces 30 in the presently described embodiment each are formed by a radially extending inner surface or flange 31 of the respective ring member 14*a*, 14*b*, 14*c*. The notches 32 therefore form gaps in part of the circumference of each engagement surface 30 to allow passage of the protrusions. The retaining member 20 comprises a notch 33 similarly to that of the movable elements 14*a*, 14*b*, 14*c* to allow passage of the protrusions 14*a*, 14*b*, 14*c* when removing the cap 6. The notch of the retaining member 20 is aligned with the slot 19 of the closure member 18 so as to allow passage of the protrusions. The movable elements therefore have multiple locked configurations in which the notches and protrusions are not aligned. In one of these locked configurations the decoy pattern is completed.

Figure 10:
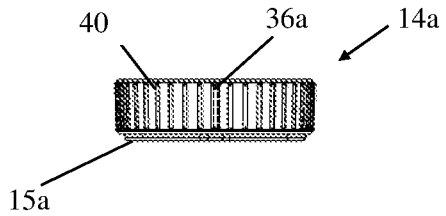
FIG. 10 is a side elevation view of the turnable ring of FIG. 8.

Referring to FIG. 10, each of the movable elements 14*a*, 14*b*, 14*c* comprises a first interlocking feature 15*a*, extending around the axis of rotation of the movable element, arranged to interlock with a corresponding second interlocking feature (labelled 15*b* in FIG. 8) of an adjacent one of the movable elements. The interlocking features are arranged to inlock to form a rotatable engagement between adjacent movable elements. This allows for the nesting and stacking of the turnable components, and also allows for easier turning and stability of the assembled cap. In the present embodiment, the first interlocking feature 15*a* comprises a base portion having a circumferentially extending outer interlocking surface that is sized to fit within a corresponding interior surface 15*b* of the outer wall of the adjacent moveable element (which therefore forms the second interlocking feature). The interlocking surface of the base portion may be tapered so that its diameter decreases in a direction parallel to the axis of rotation away from the centre of the movable element (i.e. towards the adjacent movable element with which it interlocks). This may aid alignment between the movable components. Other shapes or arrangements of interlocking features may be used in other embodiments.

In some embodiments, each movable element may comprise a plurality of notches, each configured to allow passage of a corresponding protrusion or group of protrusions. In such an embodiment multiple unlocked configurations of the movable elements may be provided. In other embodiments, a single notch is provided on each movable element as shown so that there is only a single unlocked configuration to make the closure more secure. The movable elements therefore have a single unlocked configuration, rather than a number of different possible programmable ones as might be the case with a combination lock. In yet other embodiments, each movable element may comprise a plurality of notches arranged to provide only one unlocked configuration as will be described later.

The flange on which the engagement surface 30 of each movable element 14*a*, 14*b*, 14*c* is formed is arranged to form a close fit around the tubular portion 24 of the closure member 18 so that each movable element 14*a*, 14*b*, 14*c* is rotatably mounted thereto. Each movable element 14*a*, 14*b*, 14*c* can only therefore move past the protrusions 28*a*, 28*b*, 28*c* if the notches are aligned circumferentially with the protrusion, thus providing a selective engagement between the movable elements and the container neck.

As can be seen in FIG. 11, a protrusion 28*a*, 28*b*, 28*c* is provided for each of the movable elements 14*a*, 14*b*, 14*c*. The protrusions 28*a*, 28*b*, 28*c* are spaced apart axially along the length of the container neck 10. The space between each of the protrusions 28*a*, 28*b*, 28*c* is arranged to receive one of the engagement surfaces 30 of the movable elements 14*a*, 14*b*, 14*c* so that an engagement is provided between them in the locked configuration.

When in the unlocked configuration the notches 32 can be considered to be aligned to form a passageway or tunnel through which the protrusions may move freely to allow the cap 6 to be removed from the container neck. In the presently described embodiment, the protrusions 28*a*, 28*b*, 28*c* are circumferentially aligned (e.g. at the same position around the circumference of the container neck, but offset in an axial direction) and the notches 32 align to form a linear passageway in the unlocked configuration. In other embodiments, other arrangements of protrusions may be used. For example, the protrusions may be arranged along a helical path around the container neck 10, and the notches 32 may be shaped so that a corresponding helical passageway is formed when they are aligned in the unlocked configuration. In such an embodiment, the cap 6 may be rotated so that it can be removed from the container neck 10, rather than being pulled off as in the described embodiment.

Figure 17:
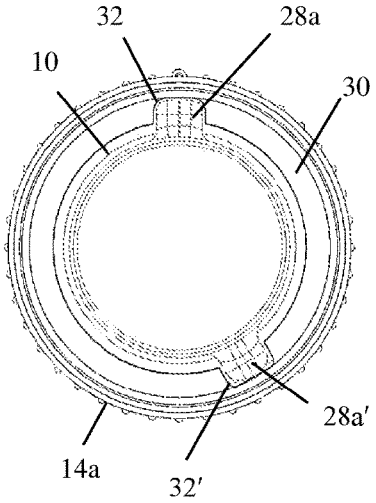
FIGS. 17 and 18 show an example embodiment of a movable element having two notches in an unlocked configuration and a locked configuration respectively.
Figure 18:
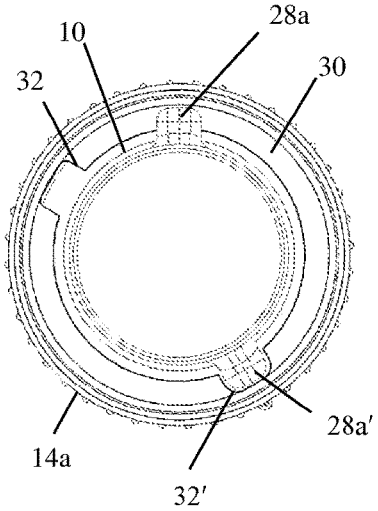

In the present embodiment, a single notch is provided on each movable element, each notch being arranged to allow passage of a corresponding protrusion on the container neck. In other embodiments, a plurality of notches (forming a set of notches) may be provided on each movable element, each arranged to allow passage of a respective one of a plurality of corresponding protrusions (forming a set of protrusion) provided on the container neck 10. An example of this is illustrated in FIGS. 17 and 18, which show a movable element 14*a* having two notches (a first notch 32 and a second notch 32') and a container neck 10 having two protrusions (a first protrusion 28*a* and a second protrusion 28*a*'). FIG. 17 shows the movable element 14*a* in an unlocked configuration in which the first notch 32 is aligned with the first protrusion 28*a*, and the second notch 32' is aligned with the second protrusion 28*a*'. FIG. 18 shows the moveable element rotated relative to its position in FIG. 17 such that it is in a locked configuration. In this configuration, the notches and protrusions are misaligned such that the engagement surface 30 of the movable element 14*a* engages with both of the protrusions 28*a*, 28*a*' to resist the movable element from being removed from the container neck 10.

As can be seen in FIGS. 17 and 18, the first and second notches and protrusions are configured such that only a single unlocked orientation of the movable element 14*a* relative to the container neck 10 is provided (i.e. so that there is a single unlocked configuration). In the embodiment of FIGS. 17 and 18 this is achieved by locating the notches 32, 32' and protrusions 28*a*, 28*a*' at positions on the movable element and neck such that there is only one orientation of the movable element relative to the neck in which the protrusion and notches are aligned. For the described embodiment, this corresponds to locating the notches at positions other than directly opposite each other around the circumference of the movable element.

While two notches and corresponding protrusions are shown in FIGS. 17 and 18, there may be more than two of each in other embodiments. By using multiple protrusions to engage with each movable element additional surfaces to prevent the removal of the cap are provided. This may be particularly advantageous where flexible movable elements are being used (as described elsewhere herein), as they are more prone to deformation.

In the embodiment shown in FIGS. 17 and 18, the notches and protrusions are all of the same size and shape. In other embodiments, the first notch 32 may have a different size and/or shape compared to the second notch 32', and the second protrusion 28*a* may have a different size and/or shape compared to the second protrusion 28*a*' such that the first protrusion 28*a* cannot pass through the second notch 32' (and optionally the second protrusion 28*a*' cannot pass through the first notch 32).

Figure 19:
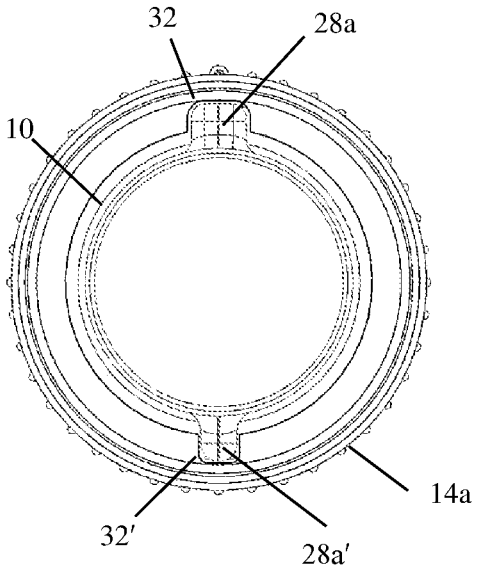
FIGS. 19 and 20 show an example embodiment of a movable element having two notches of differing sizes in an unlock configuration and a locked configuration respectively.
Figure 20:
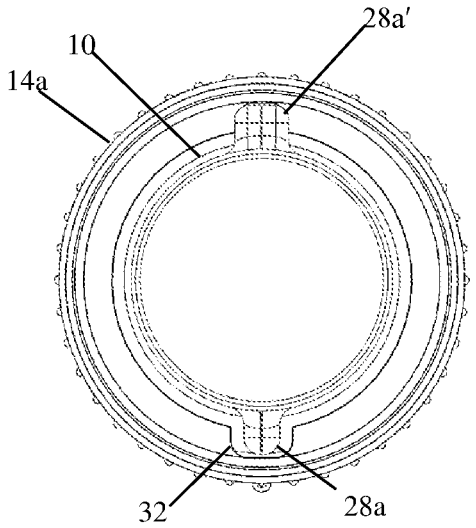

In the embodiment shown in FIGS. 19 and 20, the first notch 32 is larger in size compared to the second notch 32'. The first protrusion 28*a* is similarly larger than the second protrusion 28*a*'. The first protrusion 28*a* is sized so that it passes through the first notch 33 when they are aligned. The second protrusion 28*a*' is sized so that it passes through the second notch 32' when they are aligned. The notches and protrusions are shown in the unlocked configuration in FIG. 19 in which the first protrusion is aligned with the first notch, and the second protrusion is aligned with the second notch, thereby allowing the cap to be removed from the container neck.

The first relatively larger protrusion is sized such that it will not fit through the relatively smaller second notch. While the smaller protrusion may be able to move through the larger notch, the larger protrusion cannot move through the smaller notch, creating only one unlocked configuration. The movable element is therefore in an unlocked configuration when in a position in which the first protrusion is aligned with the second notch, and the second protrusion is aligned with the first notch, thereby preventing removal of the cap. In such an embodiment, there is only orientation of the movable element relative to the container neck in which it is in an unlock configuration. This is despite there being two orientations in which a notch can be aligned with a protrusion (as shown in FIG. 20).

In other embodiments, rather than being different in size, the notches (and corresponding protrusions) may be different in shape. In such an example, the first notch may have a different shape compared to the second notch, and the second protrusion has a different shape compared to the second protrusion such that the first protrusion 28*a* cannot pass through the second notch and the second protrusion cannot pass through the first notch.

Although two notches and protrusions are shown in FIGS. 19 and 20, each movable element may comprise more than two notches, each having a corresponding protrusion on the container neck. In such embodiments there may be a size difference between each of the notches so that no two of them are of the same size.

Although FIGS. 17 to 20 illustrate one movable element 14*a* having a plurality of notches, the same may be the case for any one or more of any additional movable elements provided (e.g. movable elements labelled 14*b* and 14*c* in FIG. 1).

Figure 21:
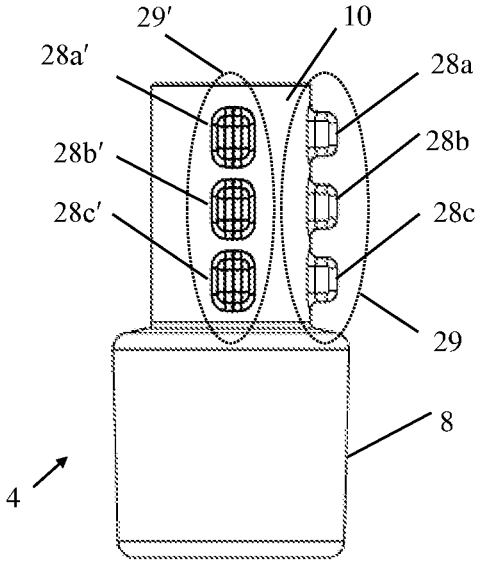
FIG. 21 shows a storage vessel of an example embodiment, the storage vessel having two groups of protrusions.

In such embodiments, as illustrated in FIG. 21, each movable element may comprise a plurality of notches to form multiple groups of notches, each group of notches configured to align with and allow passage of a corresponding group of protrusions (labelled 29 and 29' in FIG. 21) provided on the container neck (such that the container neck also has multiple groups of protrusions).

In this embodiment, the notches are positioned on the movable elements such that a single unlocked configuration of the movable elements is provided. For example, the embodiment shown FIGS. 1 to 13 may be modified to include a second group of three protrusions, similar to those shown in FIG. 13 (which in this embodiment would correspond to a first group of protrusions). In this embodiment, each movable element has a set of two notches. The notches form first and second groups corresponding to the first and second groups of protrusions. The first and second groups of protrusions (and notches) are arranged at different angles around the longitudinal axis of the neck, whereby only one unlocked configuration is provided. The protrusions of the first group of protrusions are configured to pass through the first group of notches when the movable elements are in the unlocked configuration. The protrusions of the second group of protrusions are configured to pass through the second group of notches in the movable elements when the movable elements are in the unlocked configuration. Although two groups of notches and protrusions are shown in FIG. 21, further groups may be provided such that there are two or more.

Figure 13:
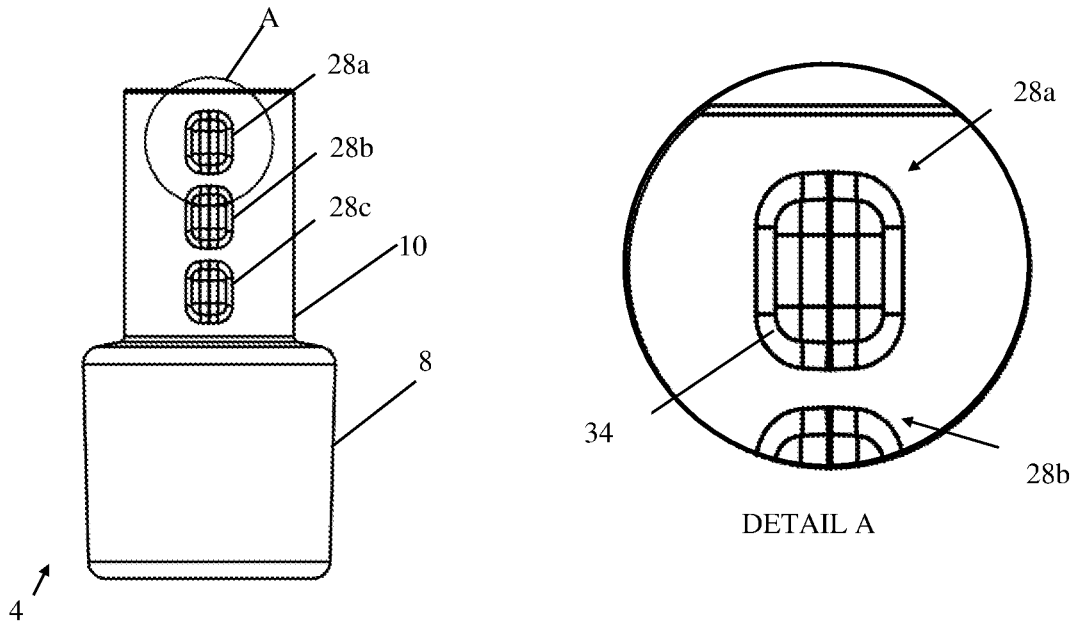
FIG. 13 is another side elevation view of the storage vessel of FIG. 11.

Referring again to FIG. 13, the protrusions 28*a*, 28*b*, 28*c* each have a tapered profile at the point of engagement with the corresponding movable element 14*a*, 14*b*, 14*c*. The tapered profile forms a camming surface 34 that is visible in the close-up detail of FIG. 13. The camming surface 34 is arranged to urge the corresponding movable element 14*a*, 14*b*, 14*c* in a direction that seals the cap 6 to the container neck 10. As can be seen in FIG. 13, the camming surface 34 is shaped to contact the engagement surface 30 of a corresponding movable element as the notch 32 is moved out of alignment with the protrusion. The contact between the camming surface 34 and engagement surface 30 pushes the movable element in a direction away from the mouth of the container (i.e. downwards in the Figures) thus pulling the lid portion 22 of the cap 6 onto the rim 10*a* of the container neck 10 to form a sealing engagement between them. The movable elements 14*a*, 14*b*, 14*c* and/or the protrusions 28*a*, 28*b*, 28*c* may be made from a flexible (e.g. resiliently deformable) material so as to aid the sealing force applied by the camming surfaces 34. In other embodiments, the sealing engagement between the cap 6 and container neck 10 may not be required, and the protrusions may have any other suitable shape.

Referring again to the assembled view of the container in FIG. 1, the movable elements 14*a*, 14*b*, 14*c* each have a physical alignment marker feature 36*a*, 36*b*, 36*c* thereon. The marker features 36*a*, 36*b*, 26*c* are arranged to align with corresponding stationary physical alignment marker features 38*a*, 38*b* on an adjacent relatively stationary part of the closure assembly when the movable elements 14*a*, 14*b*, 14*c* are in the unlocked configuration. In the present embodiment, the relatively stationary marker features include a first marker feature 38*a* provided on the lid portion 22 of the cap 6, and a second marker feature 38*b* provided on the retaining member 20. Each physical alignment marker feature 36*a*, 36*b*, 36*c*, 38*a*, 38*b* is formed by a ridge or other protrusion in the surface of the component on which it is provided. In other embodiments, grooves or other indentations may be used to form the physical marker features. By physical marker features we therefore mean features that are formed or fabricated in the surface of the component in which they are provided, rather than being only a visible indicia applied to or printed on the surface similar to those forming the decoy pattern. This means that the physical marker features are less obvious compared to the decoy pattern, and a child's attention is instead drawn to the more visible decoy pattern.

The movable elements 14*a*, 14*b*, 14*c* each further have a plurality of physical gripable features 40. The gripable features 40 are formed in the present embodiment by a series of ridges around the circumference of the ring forming each movable member. In other embodiments, any other suitable protrusions or indentations may be used to form the gripable features 40 similarly to the marker features. The gripable features 40 assist the user in gripping the movable elements 14*a*, 14*b*, 14*c* so that they may be moved to release the cap 6 from the container neck 10.

The grippable features 40 have a different size and/or shape compared to the physical marker feature of the respective movable element 14*a*, 14*b*, 14*c*. This allows the physical marker feature 36*a*, 36*b*, 36*c* to be identified from the gripable features 40 so that the movable elements can be aligned. By providing both physical gripable features 40 and physical alignment features 36*a*, 36*b*, 36*c* on the movable elements the presence of the physical alignment features may be further disguised. For example, if both gripable features 40 and marker features 36*a*, 36*b*, 36*c* are of the same type (e.g. both ridges as show in the Figures, or both other protrusions, or both indentations) the marker features may be more difficult to locate so that a child is less drawn to them. In order embodiments, the gripable features may be omitted, or are different from the marker features, e.g. they may be formed by a roughened surface texture of the movable elements. In the described embodiment a single alignment marker feature is provided on each movable element so that it is not obvious to a child trying to open the container. In other embodiments, more than one alignment marker feature may be provided on each movable member with a corresponding number of stationary alignment features.

In other embodiments, the physical marker features may be replaced with any marker features that include physical marker features as described above, as well as marker features that are formed by transfers, adhered surfaces, printed or adhered dots or markers or the like.

While in the embodiments described above the protrusions 28*a*, 28*b*, 28*c* are provided on the container neck 10 with the engagement surfaces 30 provided on the movable elements 14*a*, 14*b*, 14*c* the reverse may be the case in other embodiments. The movable elements 14*a*, 14*b*, 14*c* may therefore comprise protrusions arranged to engage with corresponding locking features on the container neck, those locking features being engagement surfaces having notches.

In use, the cap 6 may begin in a state of engagement with the container neck 10, and the movable elements 14*a*, 14*b*, 14*c* in an unlocked configuration in which the engagement surfaces 30 engage (e.g. abut) the protrusions to prevent the cap being removed. To open the container, the user may then rotate the movable elements 14*a*, 14*b*, 14*c* as described until the physical alignment marker features 36*a*, 36*b*, 36*c* on them are aligned with the physical alignment marker features 38*a*, 38*b* on the lid portion 22 of the cap 6 and the retaining member 20. The notches 32 in each engagement surface 30 are then aligned with the protrusions 28*a*, 28*b*, 28*c* to form a passage through which the protrusions can pass to remove the cap from the container. If a child were to instead attempt to open the container, they would be drawn to the decoy pattern and move the movable elements 14*a*, 14*b*, 14*c* so that the pattern appears complete. The movable members are then still in one of the unlocked configurations, such that the cap 6 cannot be removed.

As discussed above, the retaining member 20 and cap 6 comprise locking features 26*a*, 26*b* to secure them together and keep the movable elements in place. Various different configurations of locking feature may be used. For example, one of the cooperating locking features 26*a*, 26*b* may be formed by a hooked protrusions adapted to form a snap fit with a corresponding structure (e.g. hole or indentation) formed by the other of the locking features.

Figure 22:
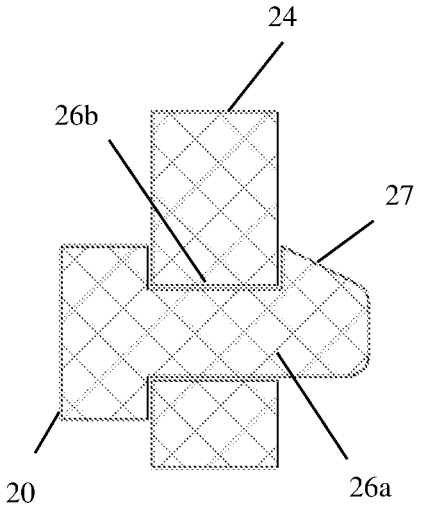
FIGS. 22 and 23 show cross sectional close up views of two examples of locking features providing a snap fit between the cap and retaining member of the container shown in FIGS. 1 to 13.
Figure 23:
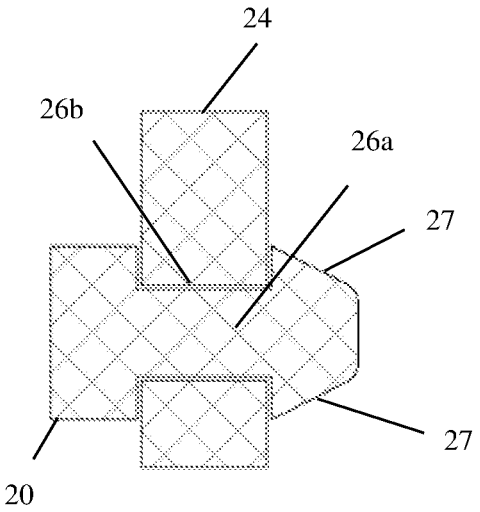

FIGS. 22 and 23 show example embodiments in which the locking feature 26*a* provided on the retaining member 20 is formed by a protrusion that is received within a corresponding aperture in the tubular portion 24 of the cap of the container so that the apertures forms a corresponding locking feature 26*b*. Hooks 27 provided on the protrusion form a snap-fit connection with the aperture as shown in the figures. The protrusions may have one or more hooks as shown in FIGS. 22 and 23.

Figure 24:
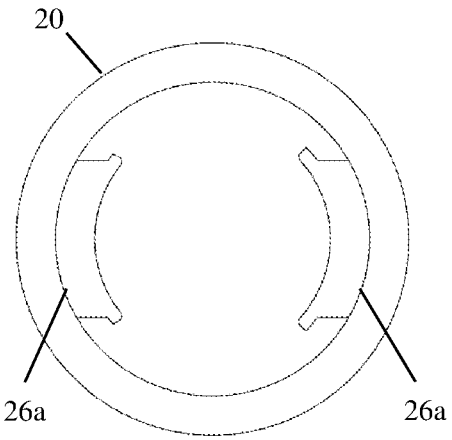
FIGS. 24 and 25 shows schematic top views of various examples of locking features that can be provided on the retaining member of the container.
Figure 25:
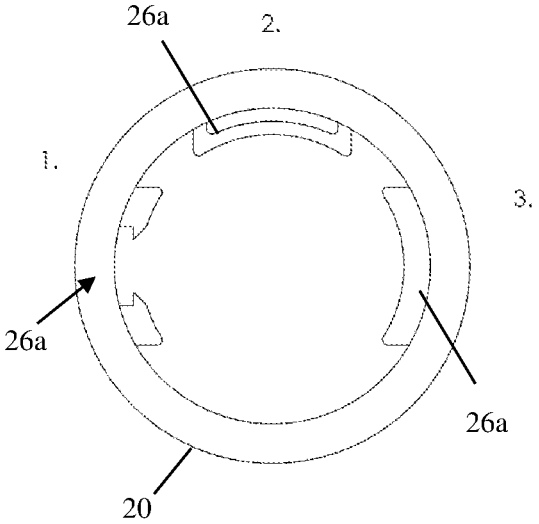
Figure 26:
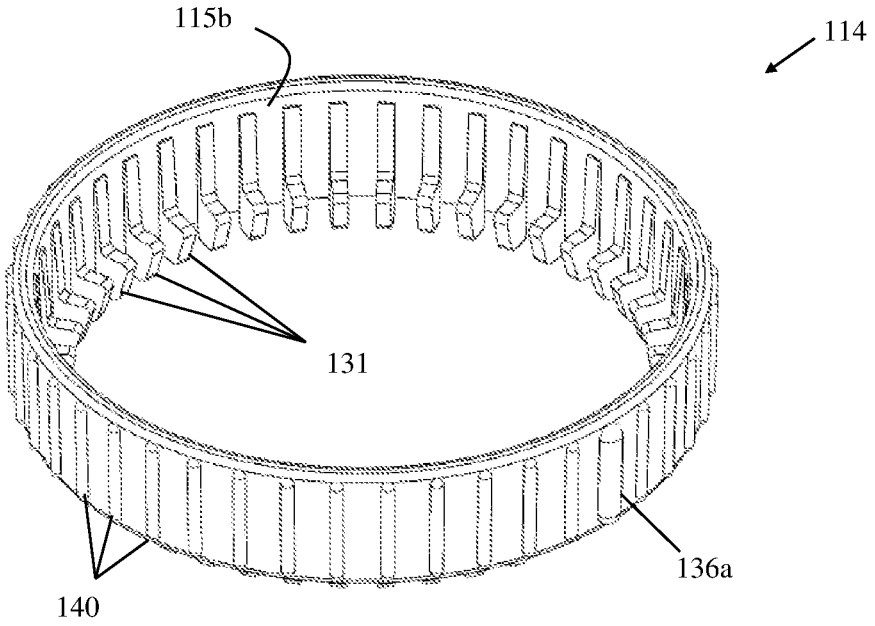
FIGS. 26, 27, 28, 29 and 30 show perspective, front elevation, side elevation, cut-away and top views of an example movable element forming part of an embodiment of a closure assembly.
Figure 27:
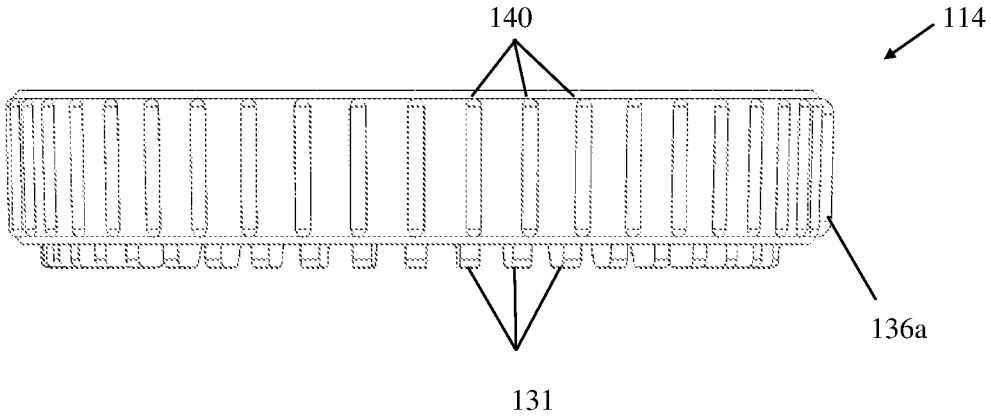
Figure 28:
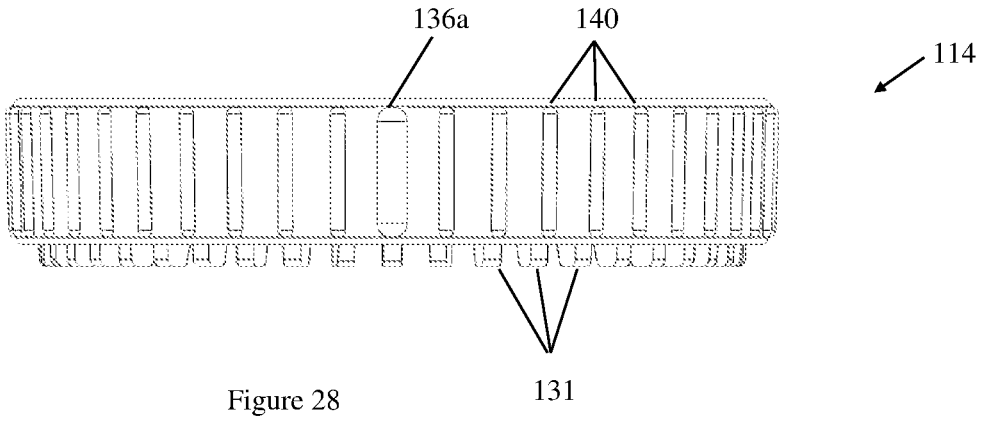
Figure 29:
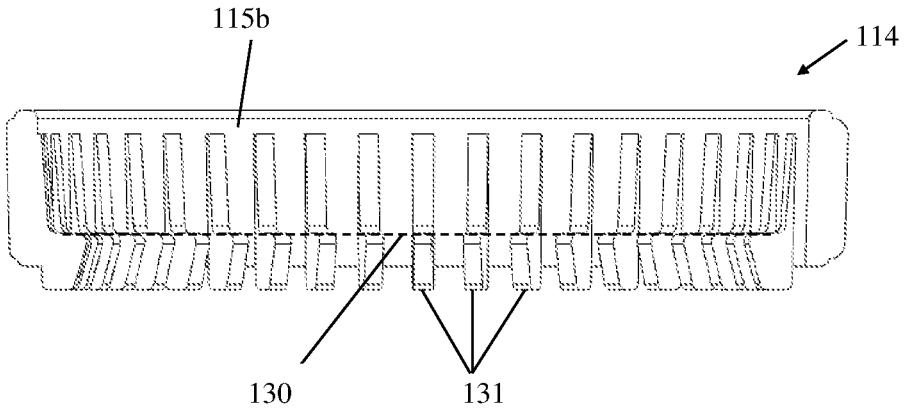

Further examples of locking features 26*a* that may be provided on the retaining member 20 are illustrated in FIGS. 24 and 25. FIG. 24 shows a further example of hooked protrusions forming the locking features 26*a* provided on the retaining member 20. In this example, the protrusions are arranged to form a snap-fit with corresponding apertures in the cap. FIG. 26 illustrates three alternative locking protrusions (labelled '1.', '2.' and '3.' in the figures). All three are shown on the same retaining member 20 for illustration purposes only—it should be understood that these can be provided separately, and located on the retaining member differently from that shown. In the first example of FIG. 25, the retaining member comprises a locking feature 26*a* formed by a pair of hooked protrusions arranged to engage with a pillar or ridge provided on the tubular portion of the cap (not shown in the figures). Multiple cooperating ridges and hooked protrusions may be provided around the circumference of the retaining member 20. The hooked protrusions may alternatively use the external hook formations shown in FIG. 24. In the second example of FIG. 25, the locking feature 26*a* on the retaining member 20 is formed by a protrusion having an indentation or space arranged to engage with a hooked protrusion provided on the container cap. The hooks may enter the indentation or space from either or both vertical directions (e.g. in a direction into or out of the page in FIG. 25). The third example of FIG. 25 shows an example of a locking feature formed by a protrusion without any hooks. The protrusion is arranged to engage with a corresponding indentation or aperture in the cap.

FIGS. 26 to 31 illustrate alternative embodiments of the movable elements 14*a*, 14*b*, 14*c*. FIGS. 26 to 31 show a movable element 114 that can be used in any of the embodiments described herein. The movable element 114 comprises a plurality of ribs or teeth 131 (three of which a labelled in the Figures). The ribs 131 extend in a radial direction from an interior surface 115*b* of the movable element 114, and are provided in place of the flange 31 shown in FIGS. 8 and 9. The ribs 131 form an engagement surface 130 corresponding to that shown in FIGS. 8 and 9. The engagement surface 130 is formed by the upper surfaces of each of the ribs 131 that engage with the protrusions 28*a*, 28*b*, 28*c* of the container neck 10 when in the locked configuration. The engagement surface 130 in this embodiment is therefore divided over the upper surfaces of the ribs, rather than being a continuous surface as in the case of the flange, as illustrated by the broken line in FIG. 29.

The engagement surface comprises a gap through which the protrusions 28*a*, 28*b*, 28*c* may pass when in the unlocked configuration, corresponding to the gap of the other embodiments of the movable elements already described. The gap in the engagement surface is formed by a space 132 between two adjacent ribs that is sized to allow the protrusions to pass therethrough. The space 132 therefore corresponds to the notch 32 shown in FIG. 9, and provides the same function of allowing the protrusions to pass through the engagement surface when in alignment.

Figure 30:
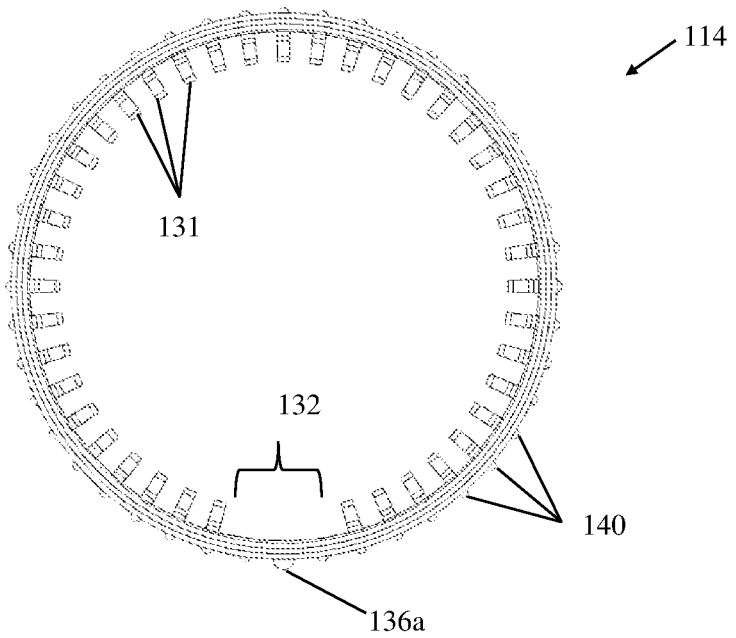
Figure 31:
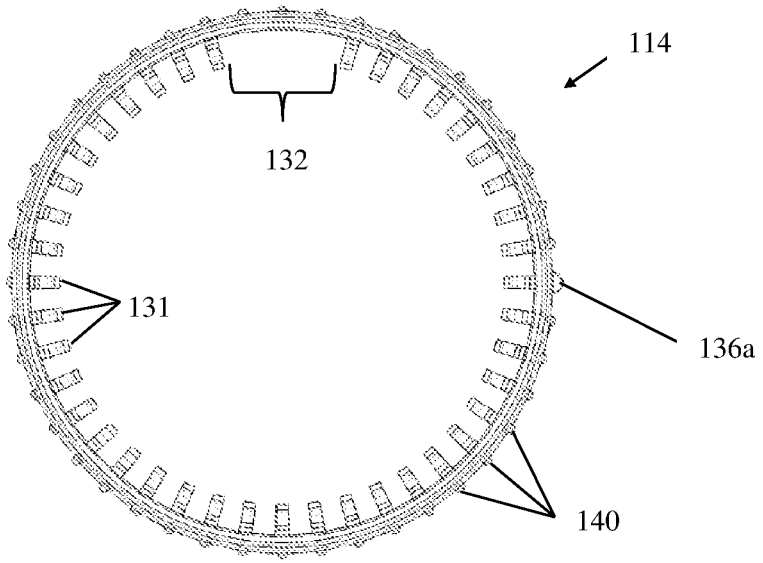
FIG. 31 shows a top view of an alternative embodiment of the movable element shown in FIGS. 26 to 30.
Figure 46:
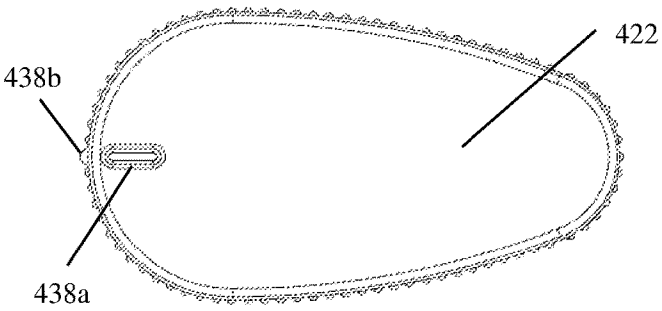
FIGS. 45, 46, 47, 48 and 49 show perspective, top, front elevation, side elevation and rear elevation views respectively of an example embodiment of a container having a container neck with an oval cross sectional shape and flexible movable elements.
Figure 45:
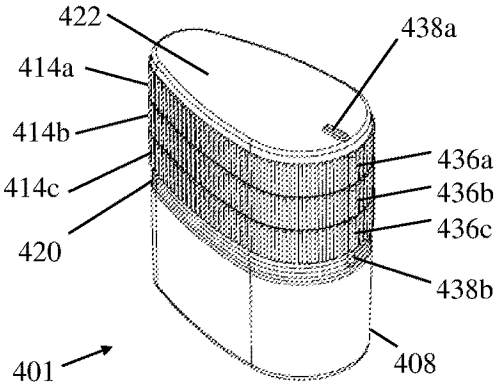
Figure 49:
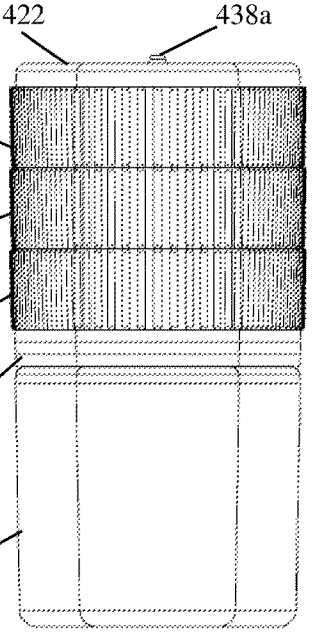
Figure 48:
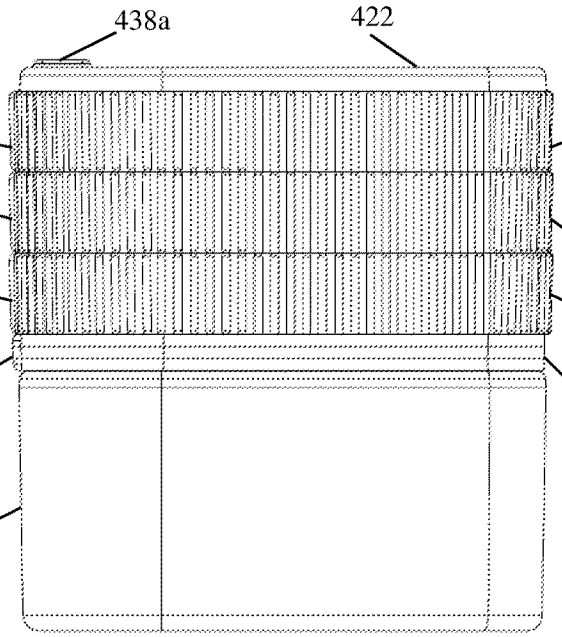
Figure 47:
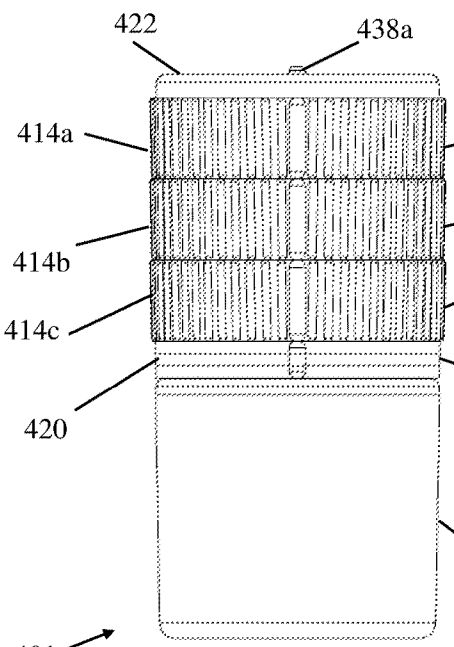
Figure 50:
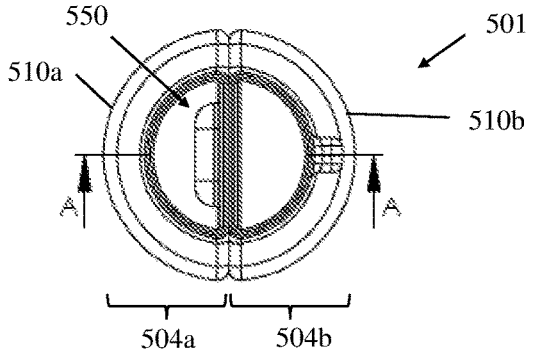
FIGS. 50, 51, 52 and 53 show top, cross sectional, side elevation and perspective views respectively of an example embodiment of a container comprising a storage vessel spit into first and second storage sections.
Figure 51:
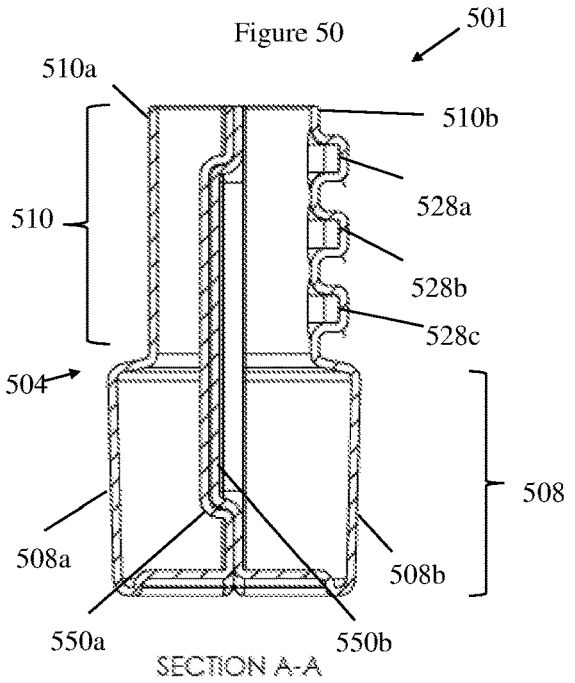
Figure 52:
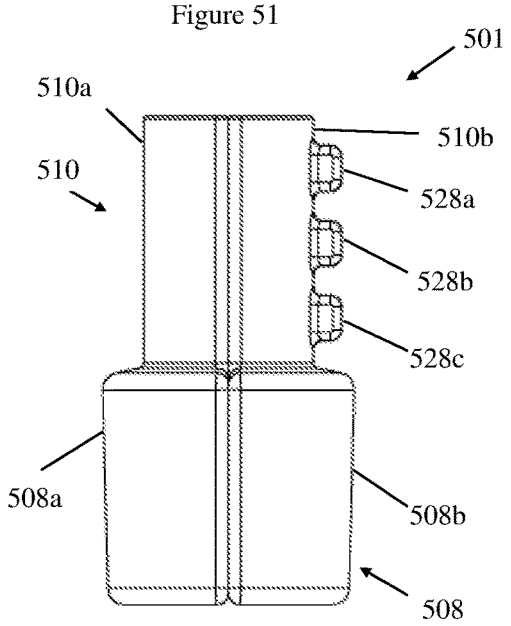
Figure 53:
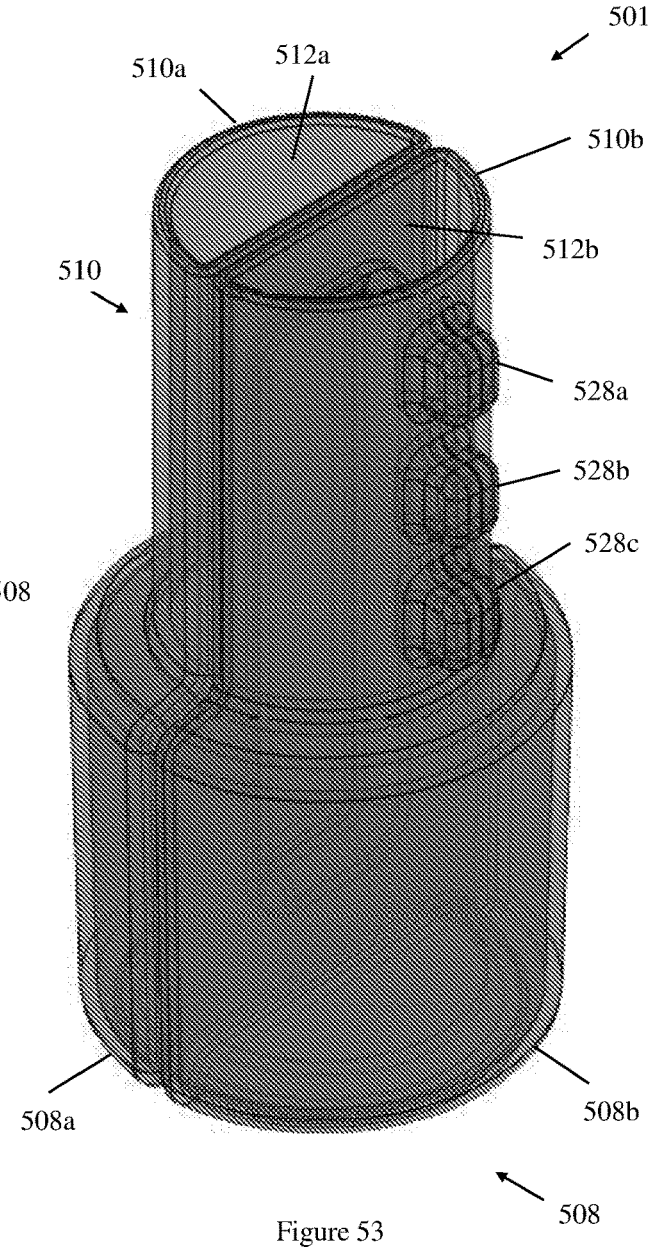

The movable element 114 has features corresponding to those of the other embodiments described above, including a physical alignment marker feature 136*a* and gripable features 140. FIG. 30 shows an embodiment in which the gap 132 is aligned with the physical marking feature 136*a*. This may not be the case, however, as shown in FIG. 31 wherein the physical marking feature 136*a* and gap 132 are not aligned. The movable elements shown in FIGS. 26 to 31 may have multiple gaps each of which may allow passage of a correspond one of multiple protrusions, similarly as described above in connection with FIGS. 17 and 18. The multiple gaps may also have different sizes/shapes similarly to as described for the notches in connection with FIGS. 19 and 20. In such embodiments, the size of the gaps is changed by spacing two adjacent ribs apart by a suitable distance.

While in the presently described embodiments the movable elements have a generally annular cross section other shapes may be provided, but which are still considered to form rings. In some embodiments, they may have an outer surface that it not cylindrical like that shown in the FIGS. 1 to 31, but may comprise flat surfaces to form a square, hexagonal, or other shape outer surface. An example of this is shown in FIGS. 32 to 37, in which a container 201 having movable elements 214*a*, 214*b*, 214*c* having an outer surface that is hexagonal in cross section. The inner surface of the movable elements (e.g. the flange forming the engagement surface 230) is however circular in cross section to allow rotation about the cap (e.g. regardless of the shape of the outer surface) as can be seen in FIG. 33.

In the embodiments described above, the movable elements 14*a*, 14*b*, 14*c*, 114 are formed from a generally rigid material. The movable elements 14*a*, 14*b*, 14*c*, 114 have a circular aperture that is sized to receive the container neck 10 such that they may be rotated about axis X as already described. The container neck therefore has a corresponding circular cross sectional shape. By "cross section" anywhere herein we mean in a plane normal to the longitudinal axis X.

In other embodiments, the movable elements 14*a*, 14*b*, 14*c*, 114 may be formed from a flexible material. In such embodiments, the flexible movable elements may be used in combination with a container having a neck and cap with non-circular cross sections. By forming the movable elements from a flexible material they are arranged to conform to the shape of the container neck and cap while still being able to rotate around the portion of the cap to which they are mounted. This allows containers of different shapes to be provided. The flexible material may be an elastic (e.g. resiliently deformable) material that is deformed from a relaxed state so that is fit around the container cap. This may aid the movable element in conforming to the required shape. In the relaxed state the flexible movable elements may be generally circular in cross sectional shape as shown in FIGS. 26 to 31.

The movable element 114 having the plurality of ribs 131 forming the engagement surface 130 may be formed from a flexible material and is particularly suited for use with non-circular container necks and caps. The ribs 131 may allow the movable element 114 to more easily deform and change shape while being rotated around the container neck and cap. The other movable elements described herein may however also be formed from a flexible material and used in combination with a non-circular neck and cap.

FIGS. 38 to 44 show various views of a container 301 having a neck 310 that has an elliptical cross section, as can be seen in particular in FIGS. 39 and 40. The container has features corresponding to those of the embodiment shown in FIGS. 1 to 13. Corresponding reference numbers are used for corresponding parts. The cap has an elliptical cross section corresponding to the container neck (e.g. the tubular member of the cap has a corresponding elliptical cross sectional shape so that it may fit over the container neck). The movable elements 314*a*, 314*b*, 314*c* adopt a corresponding elliptical cross sectional shape to the container neck and cap. In this embodiment, the storage vessel 208 of the container also has an elliptical cross section, corresponding to that of the outer surface of the movable elements 314*a*, 314*b*, 314*c*. The movable elements 314*a*, 314*b*, 314*c* are formed from a flexible material in this embodiment such that they conform to the elliptical cross section of the container neck 310 as shown in the Figures and can be rotated about the longitudinal axis of the container.

FIGS. 45 to 49 show various views of a container 401 having a container neck 410 having an oval sectional shape. The container 401 is similar to that of FIGS. 32 to 38, with similar corresponding reference numbers used for corresponding parts. The oval shape may have only one axis of symmetry as shown in the Figures, e.g. has a smaller circular profile at one end compared to the other. This may aid pouring liquids from the container. The cap has an oval cross section corresponding to the container neck (e.g. the tubular member of the cap has a corresponding oval cross sectional shape so that it may fit over the container neck). The movable elements 414*a*, 414*b*, 414*c* are formed from a flexible material and adopt a corresponding oval cross sectional shape. The storage vessel of the container 401 has an oval cross sectional shape as shown in the Figures.

The cross sectional shapes described above are examples only, and other shapes may be used. For example, the container neck and cap may have a rounded-rectangular cross sectional shape.

FIGS. 50 to 53 illustrate an embodiment of a container 501 having the closure mechanism of the present application in which the storage vessel 504 comprises first and second storage sections 504*a*, 504*b*, each arranged to provide a separate storage compartments. The first section comprises a first storage compartment 508*a*, and the second section comprises a second storage compartment 508*b*, which together form the storage chamber 508 of the container 501. The first section of the storage vessel 504 comprises a first container neck portion 510*a*, and the second section comprises a second container neck portion 510*b*, which together form the container neck 510. The first neck portion 510*a* forms the mouth of the first storage compartment 508*a*, and has a first opening 512*a* through which the first storage compartment 508*a* is accessed. The second neck portion 510*b* forms the mouth of the second storage compartment, and has a second opening 512*b* through which the second storage compartment 508*b* is accessed. In the embodiment shown in FIGS. 50 to 53 therefore, the container is split into two sections, and can be used to store multiple medications/fluids at one time.

The first and second storage sections 504*a*, 504*b* of the storage vessel are coupled together by a coupling 550. The coupling is arranged to prevent the section of the storage vessel (i.e. the second section 504*b* in the present embodiment) that does not engage with the cap via the protrusions (e.g. is held by the closure mechanism) from sliding free from the cap. The coupling 550 may be a detachable coupling. The first and second sections 504*a*, 504*b*, of the storage vessel may therefore be coupled via the coupling 550 when the cap is on the container, whereas the first and second sections 504*a*, 504*b* of the storage vessel may be detached from one another when the cap is removed. The coupled walls of the first and second sections 504*a*, 504*b* form a partition wall between the two separate storage compartments of the storage vessel.

In the present embodiment, the coupling comprises first and second interlocking coupling features 550*a*, 550*b*. The coupling shown in Figures is however only one example, and the coupling features could be any suitable number and shape. The connection could be made using multiple shaped coupling features and sliding rails. These features may be rounded, bubbled, dovetailed, slotted etc.

In other embodiments, other couplings may be used, which may not be detachable. The sections of the storage vessel may therefore be connected via an adhesive or the like.

In other embodiments, the storage vessel 504 may be split into any number of sections, i.e. two or more sections, which are not limited to the size and shape shown in the Figures. For example, the storage vessel 504 may be split into two or more sections by partition walls extending in a plane parallel to that in which the protrusions are located (i.e. further partitions parallel to that shown in the Figures). In other embodiments, the partitioning walls may have any other orientation. For example, further partition walls may be provided that intersect at the longitudinal axis X of the container to form separate storage compartments having a cross section that is a sector of the circular cross section of the storage vessel. Two partition walls may be formed that are perpendicular such that the storage vessel of the embodiment shown in FIGS. 50 to 53 is split into four quarters. Further partition walls may be provided to form compartments with a wedge shaped cross section.

While in the embodiment shown in FIGS. 50 to 53 the first and second storage sections are formed from separate components, this may not be the case in other embodiments. For example, the first and second storage sections may be formed integrally from a single component e.g. an integral dividing wall or walls may be provided in the container of FIGS. 1 to 13.

While in the presently described embodiments the movable elements have been described as being mounted to the cap 6 they may instead be mounted to the container neck 10. In such an embodiment, the movable elements may be rotatably mounted to the container neck, with the cap having corresponding protrusions to which the movable elements may engage in a similar manner as for the other embodiments described herein. In this embodiment, the protrusions and engagement surfaces having gaps may again be reversed, so that the protrusions are on the movable elements and the engagement surfaces on the cap.

The movable elements are therefore movably mounted to one of the container neck or the cap, the other of the container neck and the cap having a locking feature adapted to engage with the movable elements. The movable elements may have one of protrusions or engagement surfaces with gaps; and the locking features of the container neck or cap may comprise the other of engagement surfaces with gaps or protrusions.

Figure 54:
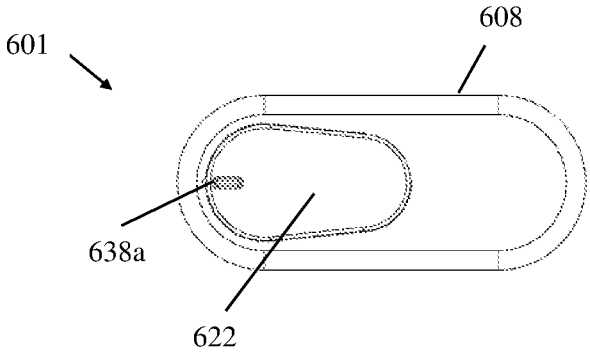
FIGS. 54, 55 and 56 show top, first side elevation and second side elevation views respectively of an example embodiment of a container suitable for use in storing house hold cleaning products.
Figure 55:
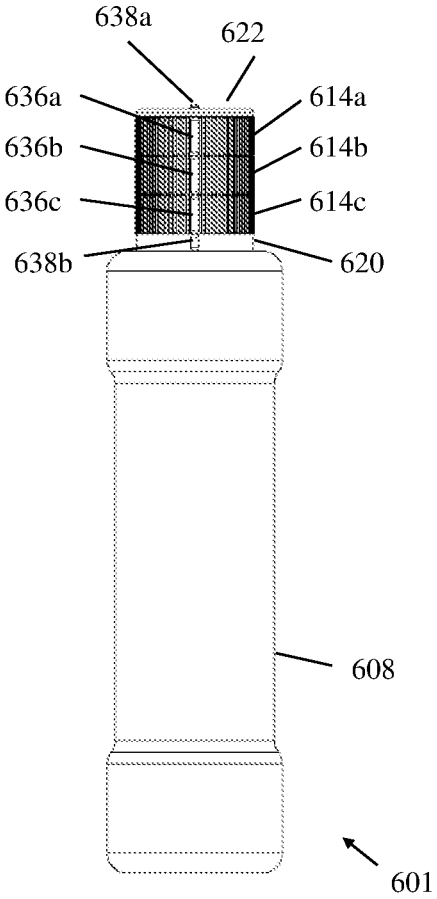
Figure 56:
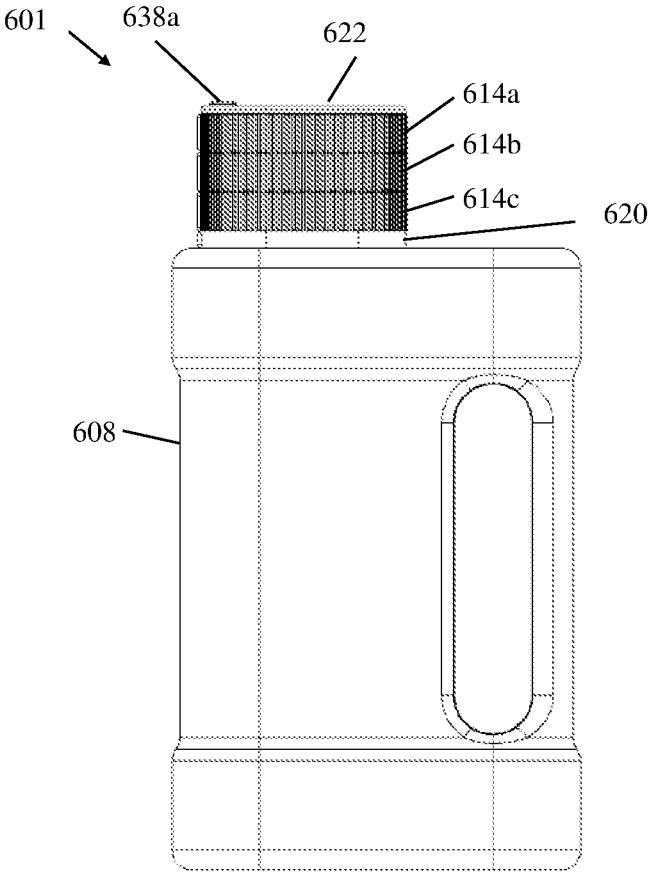

In the embodiments described above and shown in FIGS. 1 to 53, the container is suitable for use as a medicine bottle. The present application is not however limited to these embodiments, and the container can be adapted for storage of things other than medicine. For example, FIGS. 54 to 56 illustrate another embodiment of a container 601 comprising the closure assembly of the present application. The container 601 shown in FIGS. 54 to 56 is suitable for use in storing house hold cleaning products, such as bleach or the like. The container 601 comprises a container neck and cap having an oval cross sectional shape similar to that shown in FIGS. 45 to 49, and is provided with a similar closure assembly. Corresponding components are labelled accordingly. In other embodiments, any of the closure assemblies described herein could be used in combination with the container 601 of FIGS. 54 to 56. The container shown in FIG. 54 to 56 is one example of an alternative use of the closure assembly of the present application, which can be used on any relevant type of container where a safety or child resistant closure assembly is desired.

Any reference to 'axial' or 'axially' herein is in a direction parallel to a longitudinal axis of the container extending through the container neck as illustrated in FIG. 11, labeled axis 'X'. The components of the cap each have a respective longitudinal axis which overlaps axis X when the cap is coupled to the storage vessel. Any reference to radial herein is relative to the longitudinal axis, e.g. in a direction perpendicular to that axis.

It will be understood that the invention is not limited to the embodiments above-described and various modifications and improvements can be made without departing from the concepts herein. Except where mutually exclusive, any of the features may be employed separately or in combination with any other features and the disclosure extends to and includes all combinations and sub-combinations of one or more features described herein.

The invention claimed is:

1. A container closure assembly comprising:

a container neck;

a cap adapted to removably engage with the container neck, the cap arranged to close an opening of the container neck when engaged therewith;

one or more movable elements, the movable elements arranged to provide a selective engagement between the container neck and the cap, wherein:

the one or more movable elements have one or more graphical indicia thereon to form at least part of at least one decoy pattern, the one or more movable elements have a locked configuration in which the cap is engaged with the container neck and the decoy pattern is complete, and the one or more movable elements have an unlocked configuration in which the cap is disengaged from the container neck and the decoy pattern is not complete, wherein the one or more movable elements have further locked configurations in which the cap is engaged with the container neck and the decoy pattern is not complete.

2. The container closure assembly according to claim 1, wherein the movable elements are arranged to rotate about a longitudinal axis extending through the container neck.

3. The container closure assembly according to claim 1, wherein each of the movable elements are movably mounted to one of the container neck or the cap, and the other of the container neck or the cap comprises one or more locking features, the one or more movable elements being arranged to engage with the one or more locking features when in the locked configuration to resist removal of the cap from the container neck.

4. The container closure assembly according to claim 3, wherein:

the container neck and cap have a non-circular cross sectional shape; and each of the movable elements are formed from a flexible material, the movable elements being arranged to conform to the shape of the container neck and cap during rotation.

5. The container closure assembly according to claim 3, wherein the one or more movable elements or the one or more locking features each comprise an engagement surface having a gap therein, and the other of the one or more movable elements and the one or more locking features each comprise a corresponding locking protrusion, wherein:

in the locked configuration the engagement surface or surfaces are arranged to engage with a corresponding one of the locking protrusion or protrusions to resist removal of the cap; and in the unlocked configuration the locking protrusion or protrusions are arranged to pass through the gap or gaps to allow removal of the cap.

6. The container closure assembly according to claim 5, wherein the engagement surface of each of the one or more movable elements comprises a set of a plurality of gaps, each gap corresponding to one of a set of a plurality of locking protrusions, and wherein:

in the locked configuration the engagement surface or surfaces are each arranged to engage with the locking protrusions of the corresponding set or sets of locking protrusions to resist removal of the cap; and in the unlocked configuration the locking protrusions of the set or sets of locking protrusions are arranged to pass through the gaps of the corresponding set or sets of gaps to allow removal of the cap.

7. The container closure assembly according to claim 6, wherein:

a) the gaps within each set, and corresponding locking protrusions within each set, are positioned such that only one orientation of each movable element relative to the container neck or the cap corresponds to the unlocked configuration; and/or b) the gaps within each set, and corresponding locking protrusions within each set, have a different size and/or shape relative to the other gaps and protrusions in the same set whereby only one orientation of each movable element relative to the container neck or the cap corresponds to the unlocked configuration.

8. The container closure assembly according to claim 5, wherein any one or more of the locking protrusions have a tapered profile at the point of engagement with a corresponding engagement surface, the tapered profile forming a camming surface arranged to urge the cap towards engagement with the container neck.

9. The container closure assembly according to claim 5, wherein:

a) the engagement surface of at least one or each moveable element is formed by the surface of a flange provided on each movable element, and wherein the gap or gaps in the engagement surface are each formed by a notch in the flange; and/or b) the engagement surface of at least one or each movable element is formed by a plurality of spaced apart radially extending ribs provided on each movable element, and wherein the gap or gaps in the engagement surface are each formed by a space between two adjacent ribs.

10. The container closure assembly according to claim 5, wherein the one or more movable elements comprise at least two movable elements having engagement surfaces each having at least one gap, and wherein in the unlocked configuration the gaps of the movable elements form a continuous passageway or passageways through which the protrusions are free to pass to allow removable of the cap from the container.

11. The container closure assembly according to claim 10, wherein the one or more protrusions comprises at least two protrusions provided on the container neck, each corresponding to a corresponding one of the at least two movable elements, and:

a) wherein the at least two protrusions are spaced apart to allow passage of the engagement surface or surfaces between them; and/or b) wherein the at least two protrusions are arranged along an axis parallel to the longitudinal axis extending through the container neck.

12. The container closure assembly according to claim 1, wherein the one or more movable elements each have a marker feature thereon, wherein the marker feature is adapted to align with a corresponding marker feature on a relatively stationary part of the container closure assembly when the movable elements are in the unlocked configuration.

13. The container closure assembly according to claim 12, wherein the one or more movable elements each further have a plurality of physical gripable features thereon, the gripable features having a different size and/or shape compared to the marker feature of the respective movable element.

14. The container closure assembly according to claim 13, wherein the marker features and/or the physical gripable features are formed by surface indentations and/or protrusions.

15. The container closure assembly according to claim 13, wherein the marker features and the physical gripable features are both formed by indentations or both formed by protrusions.

16. The container closure assembly according to claim 1, comprising a plurality of movable elements arranged to rotate around an axis of rotation, wherein at least one of the movable elements comprises a first interlocking feature extending around the axis of rotation arranged to inlock with a corresponding second interlocking feature of an adjacent one of the movable elements, and wherein the first interlocking feature comprises a base portion of the respective movable element having a circumferentially extending interlocking surface that is sized to fit within a corresponding interior surface of the adjacent moveable element.

17. A container comprising the container closure assembly according to claim 1, wherein the container comprises a storage vessel, the storage vessel comprising a storage chamber and the container neck, the container neck being formed integrally with the storage vessel or fixedly attached thereto.

18. A cap for a container, the cap being adapted to removably engage with a container neck of the container to close an opening of the container neck when engaged therewith, wherein the cap comprises one or more movable elements, the movable elements arranged to provide a selective engagement between the container neck and the cap, and wherein:

the movable elements have one or more graphical indicia thereon to form at least one decoy pattern, the movable elements have a locked configuration in which the decoy pattern is complete and the cap is arranged to be engaged with the container neck, and the movable elements have an unlocked configuration in which the decoy pattern is not complete and the cap is arranged to be disengageable from the container neck, wherein the one or more movable elements have further locked configurations in which the cap is arranged to be engaged with the container neck and the decoy pattern is not complete.

19. A storage vessel comprising a storage chamber and a container neck formed integrally with the storage chamber or fixedly attached thereto, the container neck adapted to removably engage with a cap to close an opening of the container neck when engaged therewith, wherein the container neck comprises one or more movable elements, the movable elements arranged to provide a selective engagement between the container neck and the cap, and wherein:

the movable elements have one or more graphical indicia thereon to form at least one decoy pattern, the movable elements have a locked configuration in which the decoy pattern is complete and the cap is arranged to be engaged with the container neck, and the movable elements have an unlocked configuration in which the decoy pattern is not complete and the cap is arranged to be disengeable from the container neck, wherein the one or more movable elements have further locked configurations in which the cap is arranged to be engaged with the container neck and the decoy pattern is not complete.

20. The container of claim 17, wherein the storage vessel comprises a first section comprising a first storage section and a first container neck portion, and a second section comprising a second storage section and second container neck portion.

* * * * *